US011220368B2

(12) United States Patent
Hanan et al.

(10) Patent No.: US 11,220,368 B2
(45) **Date of Patent: *Jan. 11, 2022**

(54) SWIRL BELL BOTTLE WITH WAVY RIBS

(71) Applicant: Niagara Bottling, LLC, Ontario, CA (US)

(72) Inventors: Jay Clarke Hanan, Ontario, CA (US); Jochen Forsthovel, Regensburg (DE); Alexander Schau, Regensburg (DE)

(73) Assignee: Niagara Bottling, LLC, Diamond Bar, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/012,029

(22) Filed: Jun. 19, 2018

(65) Prior Publication Data

US 2018/0297741 A1 Oct. 18, 2018

Related U.S. Application Data

(63) Continuation of application No. 14/610,940, filed on Jan. 30, 2015, now Pat. No. 10,023,346, which is a (Continued)

(51) Int. Cl.
*B65D 1/02* (2006.01)

(52) U.S. Cl.
CPC ..... *B65D 1/0284* (2013.01); *B65D 1/0223* (2013.01); *B65D 2501/0036* (2013.01)

(58) Field of Classification Search
CPC ..... B65D 8/00; B65D 1/44; B65D 1/0284; B65D 1/0223; B65D 2501/0036; B29B 2911/14486

(Continued)

(56) References Cited

U.S. PATENT DOCUMENTS

D53,694 S 8/1919 Taylor
D63,200 S 10/1923 Root (Continued)

FOREIGN PATENT DOCUMENTS

DE 69813841 T2 12/2003
DE 602004008115 T2 4/2008

(Continued)

OTHER PUBLICATIONS

International Search Report with Written Opinion for related Application No. PCT/US2014/011923 dated May 19, 2014 (6 Pages).

(Continued)

*Primary Examiner* — Anthony D Stashick
*Assistant Examiner* — Raven Collins
(74) *Attorney, Agent, or Firm* — Michael Best & Friedrich LLP

(57) ABSTRACT

An apparatus is provided for a container comprising a base, a bell, a sidewall between the base and the bell, a neck and a finish which define an opening to an interior of the container, and a shoulder between the sidewall and the bell. Strap ribs extend from a central portion of the base and terminate at the sidewall. The strap ribs cooperate with vertically aligned recessed columns of the sidewall to resist bending, leaning, crumbling, or stretching along the sidewall and the base. An inwardly offset portion of the sidewall is disposed between each pair of adjacent recessed columns. The inwardly offset portions of the sidewall are configured to resist outward bowing of the sidewall due to internal pressure of contents within the container.

10 Claims, 11 Drawing Sheets

Related U.S. Application Data continuation-in-part of application No. 14/157,400, filed on Jan. 16, 2014, now Pat. No. 9,120,589, which is a continuation-in-part of application No. 14/141,224, filed on Dec. 26, 2013, now Pat. No. 9,132,933.

(60) Provisional application No. 61/746,535, filed on Dec. 27, 2012.

(58) Field of Classification Search
USPC ..... 215/370, 382
See application file for complete search history.

(56) References Cited

U.S. PATENT DOCUMENTS

D97,600 S 11/1935 Fuerst
D98,396 S 1/1936 Gray
D103,426 S 3/1937 Fuerst
D176,487 S 12/1955 Sherman
3,029,963 A 4/1962 Evers
D212,460 S 10/1968 Pettengil
3,438,578 A 4/1969 Moyer et al.
D249,121 S 8/1978 Strand
4,170,622 A 10/1979 Uhlig
4,316,551 A 2/1982 Belokin, Jr.
4,374,878 A 2/1983 Jakobsen et al.
D294,462 S 3/1988 Ota et al.
4,756,439 A 7/1988 Perock
4,818,575 A 4/1989 Hirata et al.
4,847,129 A 7/1989 Collette et al.
4,863,046 A 9/1989 Collette et al.
4,907,709 A 3/1990 Abe et al.
4,997,692 A 3/1991 Yoshino
D315,869 S 4/1991 Collette
D321,830 S 11/1991 York et al.
5,067,622 A 11/1991 Garver et al.
5,092,475 A 3/1992 Krishnakumar et al.
5,133,468 A 7/1992 Brunson et al.
5,178,289 A 1/1993 Krishnakumar et al.
5,199,588 A 4/1993 Hayashi
5,255,889 A 10/1993 Collette et al.
5,279,433 A 1/1994 Krishnakumar et al.
5,281,387 A 1/1994 Collette et al.
D345,693 S 4/1994 Edstrom
5,303,833 A 4/1994 Hayashi et al.
5,303,834 A 4/1994 Krishnakumar et al.
5,337,909 A 8/1994 Vailliencourt
5,341,946 A 8/1994 Vailliencourt et al.
D352,238 S 11/1994 Vailliencourt et al.
D352,245 S 11/1994 Krishnakumar et al.
5,381,910 A 1/1995 Sigiura et al.
5,407,086 A 4/1995 Ota et al.
D358,766 S 5/1995 Vailliencourt et al.
5,411,699 A 5/1995 Collette et al.
D364,565 S 11/1995 Vailliencourt et al.
D366,416 S 1/1996 Semersky
D366,417 S 1/1996 Semersky
5,632,397 A 5/1997 Fandeu et al.
5,669,520 A 9/1997 Simpson
5,704,503 A 1/1998 Krishnakumar et al.
D391,168 S 2/1998 Ogg
D393,802 S 4/1998 Collette et al.
5,762,221 A 6/1998 Tobias et al.
5,785,197 A 7/1998 Slat
D397,614 S 9/1998 Krishnakumar et al.
D402,895 S 12/1998 Takahashi et al.
D404,308 S 1/1999 Takahashi et al.
5,888,598 A 3/1999 Brewster et al.
D407,649 S 4/1999 Mccallister et al.
D407,650 S 4/1999 Takahashi et al.
D411,453 S 6/1999 Piccioli et al.
5,908,128 A 6/1999 Krishnakumar et al.
D413,519 S 9/1999 Eberle et al.
5,971,184 A 10/1999 Krishnakumar et al.
5,988,417 A 11/1999 Cheng et al.
6,016,932 A 1/2000 Gaydosh et al.
D419,882 S 2/2000 Bretz et al.
D420,592 S 2/2000 Bretz et al.
6,036,037 A 3/2000 Scheffer et al.
D423,365 S 4/2000 Eberle
6,044,996 A 4/2000 Carew et al.
6,044,997 A 4/2000 Ogg
6,062,409 A 5/2000 Eberle
D426,460 S 6/2000 Krishnakumar et al.
D427,905 S 7/2000 Eberle
6,092,688 A 7/2000 Eberle
D427,649 S 8/2000 Warner et al.
6,095,360 A 8/2000 Shmagin et al.
D430,493 S 9/2000 Weick
6,112,925 A 9/2000 Nahill et al.
D434,330 S 11/2000 Rowe et al.
6,149,024 A 11/2000 Deemer et al.
D440,157 S 4/2001 Lichtman et al.
D440,158 S 4/2001 Bretz et al.
D440,877 S 4/2001 Lichtman et al.
D441,294 S 5/2001 Lichtman et al.
6,230,912 B1 5/2001 Rashid
6,248,413 B1 6/2001 Barel et al.
D445,033 S 7/2001 Bretz et al.
6,257,433 B1 7/2001 Ogg et al.
D446,126 S 8/2001 Bretz et al.
D447,411 S 9/2001 Lichtman et al.
6,296,131 B2 10/2001 Rashid
D452,655 S 1/2002 Considine
6,347,717 B1 2/2002 Eberle
D454,500 S 3/2002 Bretz et al.
D465,158 S 11/2002 Peet et al.
D466,021 S 11/2002 Thierjung et al.
D466,819 S 12/2002 Darr et al.
6,494,333 B2 12/2002 Sasaki et al.
D469,358 S 1/2003 Bryant et al.
D469,359 S 1/2003 Bryant et al.
D469,695 S 2/2003 Bryant et al.
D469,696 S 2/2003 Bryant et al.
D470,773 S 2/2003 Darr et al.
6,554,146 B1 4/2003 DeGroff et al.
6,585,125 B1 7/2003 Peek
6,616,001 B2 9/2003 Saito et al.
6,722,514 B2 4/2004 Renz
6,739,467 B2 5/2004 Saito et al.
6,830,158 B2 12/2004 Yourist
6,841,262 B1 1/2005 Beck et al.
D504,063 S 4/2005 Bretz et al.
D506,675 S 6/2005 Bretz et al.
D506,676 S 6/2005 Bretz et al.
D506,677 S 6/2005 Bretz et al.
D507,491 S 7/2005 Bretz et al.
D507,609 S 7/2005 Bretz et al.
D507,749 S 7/2005 Bretz et al.
D508,857 S 8/2005 Bretz et al.
6,932,230 B2 8/2005 Pedmo et al.
D510,526 S 10/2005 Bretz et al.
6,974,047 B2 12/2005 Kelley et al.
7,017,763 B2 3/2006 Kelley
7,025,219 B2 4/2006 Heisner et al.
7,032,770 B2 4/2006 Finlay et al.
7,051,892 B1 5/2006 O'Day, Jr.
D525,530 S 7/2006 Livingston et al.
D527,643 S 9/2006 Gottlieb
7,172,087 B1 2/2007 Axe et al.
D538,660 S 3/2007 Gatewood
7,198,164 B2 4/2007 Yourist et al.
D548,106 S 8/2007 Martinez et al.
7,258,244 B2 8/2007 Ungrady
D551,081 S 9/2007 Ohara et al.
7,267,242 B2 9/2007 Tanaka et al.
D555,499 S 11/2007 Ross
7,334,695 B2 2/2008 Bysick et al.
7,334,696 B2 2/2008 Tanaka et al.
7,347,339 B2 3/2008 Bangi et al.
7,364,046 B2 4/2008 Joshi et al.
7,416,089 B2 8/2008 Kraft et al.
7,416,090 B2 8/2008 Mooney et al.
D579,339 S 10/2008 Shmagin

(56) References Cited

U.S. PATENT DOCUMENTS

| | | | |
|---|---|---|---|
| 7,445,826 | B2 | 11/2008 | Collette et al. |
| 7,455,189 | B2 | 11/2008 | Lane et al. |
| 7,469,796 | B2 | 12/2008 | Kamineni et al. |
| D584,627 | S | 1/2009 | Lepoitevin |
| 7,543,713 | B2 | 6/2009 | Trude et al. |
| D598,779 | S | 8/2009 | Lepoitevin |
| D610,015 | S | 2/2010 | Yourist et al. |
| 7,694,842 | B2 | 4/2010 | Melrose |
| 7,699,183 | B2 | 4/2010 | Matsuoka et al. |
| 7,748,551 | B2 | 7/2010 | Gatewood et al. |
| 7,748,552 | B2 | 7/2010 | Livingston et al. |
| 7,757,874 | B2 | 7/2010 | Ross |
| D621,271 | S | 8/2010 | Soni |
| 7,780,025 | B2 | 8/2010 | Simpson, Jr. et al. |
| D623,529 | S | 9/2010 | Yourist et al. |
| D624,427 | S | 9/2010 | Yourist et al. |
| 7,798,349 | B2 | 9/2010 | Maczek et al. |
| 7,802,691 | B2 | 9/2010 | Musalek et al. |
| D626,850 | S | 11/2010 | Xoppas |
| D630,515 | S | 1/2011 | Bretz et al. |
| 7,861,876 | B2 | 1/2011 | Stowitts |
| 7,874,442 | B2 | 1/2011 | Nievierowski et al. |
| 7,980,404 | B2 | 7/2011 | Trude et al. |
| 8,020,717 | B2 | 9/2011 | Patel |
| 8,047,388 | B2 | 11/2011 | Kelley et al. |
| 8,091,720 | B2 | 1/2012 | Colloud |
| 8,113,368 | B2 | 2/2012 | Oguchi et al. |
| D658,065 | S | 4/2012 | Oommen et al. |
| 8,162,162 | B2 | 4/2012 | Hata et al. |
| 8,256,634 | B2 | 9/2012 | Tanaka |
| 8,276,774 | B2 | 10/2012 | Patcheak et al. |
| 8,276,775 | B2 | 10/2012 | Boukobza |
| 8,286,814 | B2 | 10/2012 | Prichett, Jr. |
| 8,308,007 | B2 | 11/2012 | Mast et al. |
| 8,328,033 | B2 | 12/2012 | Mast |
| 8,365,915 | B2 | 2/2013 | Hunter et al. |
| 8,381,496 | B2 | 2/2013 | Trude et al. |
| 8,486,325 | B2 | 7/2013 | Siegl |
| 8,496,130 | B2 | 7/2013 | Lane et al. |
| 8,544,663 | B2 | 10/2013 | Barel |
| 8,556,098 | B2 | 10/2013 | Peykoff et al. |
| 8,561,822 | B2 | 10/2013 | Beck |
| 8,567,625 | B2 | 10/2013 | Nemeto |
| D696,126 | S | 12/2013 | Sanderson |
| D699,116 | S | 2/2014 | Sanderson |
| 9,120,589 | B2 | 9/2015 | Hanan |
| 9,132,933 | B2 | 9/2015 | Hanan |
| 10,023,346 | B2 | 7/2018 | Hanan et al. |
| 10,150,585 | B2 | 12/2018 | Peykoff et al. |
| 10,202,217 | B2 | 2/2019 | Hanan et al. |
| 10,358,252 | B2 | 7/2019 | Hanan et al. |
| 10,654,609 | B2 | 5/2020 | Hanan et al. |
| 10,807,759 | B2 | 10/2020 | Hanan et al. |
| 2001/0027978 | A1 | 10/2001 | Finlay |
| 2001/0030166 | A1 | 10/2001 | Ozawa et al. |
| 2004/0000533 | A1 | 1/2004 | Kamineni et al. |
| 2005/0279728 | A1 | 12/2005 | Finlay et al. |
| 2006/0070977 | A1 | 4/2006 | Howell et al. |
| 2006/0113274 | A1 | 6/2006 | Keller et al. |
| 2006/0131257 | A1 | 6/2006 | Gatewood et al. |
| 2006/0157439 | A1 | 7/2006 | Howell |
| 2006/0186083 | A1 | 8/2006 | Joshi et al. |
| 2007/0131644 | A1 | 6/2007 | Melrose |
| 2007/0145000 | A1 | 6/2007 | Musalek |
| 2008/0073315 | A1* | 3/2008 | Hermel ..... B65D 1/0223 215/379 |
| 2008/0087628 | A1 | 4/2008 | Sangi et al. |
| 2008/0173614 | A1 | 7/2008 | Matsuoka |
| 2008/0197105 | A1 | 8/2008 | Boukobuza |
| 2008/0223816 | A1 | 9/2008 | Darr et al. |
| 2008/0257855 | A1 | 10/2008 | Patel |
| 2009/0020497 | A1 | 1/2009 | Tanaka et al. |
| 2009/0057263 | A1* | 3/2009 | Barker ..... B65D 1/44 215/381 |
| 2009/0065468 | A1 | 3/2009 | Hata et al. |
| 2009/0308835 | A1 | 3/2009 | Boukobza |
| 2009/0159556 | A1 | 6/2009 | Patcheak et al. |
| 2009/0166314 | A1 | 7/2009 | Matsouka |
| 2009/0184127 | A1 | 7/2009 | Mooney |
| 2009/0261058 | A1 | 10/2009 | Prichett, Jr. |
| 2009/0261059 | A1 | 10/2009 | Prichett, Jr. |
| 2009/0283495 | A1 | 11/2009 | Lane et al. |
| 2009/0321383 | A1 | 12/2009 | Lane |
| 2010/0028577 | A1 | 2/2010 | Siegl |
| 2010/0072165 | A1* | 3/2010 | Schau ..... B65D 1/0284 215/371 |
| 2010/0089856 | A1 | 4/2010 | Oguchi et al. |
| 2010/0155359 | A1 | 6/2010 | Simon et al. |
| 2010/0163513 | A1 | 7/2010 | Pedmo |
| 2010/0176081 | A1 | 7/2010 | Kamineni et al. |
| 2010/0206837 | A1 | 8/2010 | Deemer et al. |
| 2010/0206838 | A1 | 8/2010 | Mast et al. |
| 2010/0206839 | A1 | 8/2010 | Tanaka et al. |
| 2010/0206892 | A1 | 8/2010 | Mast |
| 2010/0213204 | A1 | 8/2010 | Melrose |
| 2010/0230378 | A1 | 9/2010 | Colloud |
| 2010/0270259 | A1 | 10/2010 | Russell et al. |
| 2010/0297375 | A1 | 11/2010 | Protais et al. |
| 2010/0304168 | A1 | 12/2010 | Dornback |
| 2010/0304169 | A1 | 12/2010 | Dornback |
| 2010/0314348 | A1 | 12/2010 | Zoppas et al. |
| 2010/0320218 | A1 | 12/2010 | Tanaka |
| 2011/0017700 | A1 | 1/2011 | Patcheak et al. |
| 2011/0073559 | A1 | 3/2011 | Schlies et al. |
| 2011/0115135 | A1 | 5/2011 | Siegl |
| 2011/0132863 | A1 | 6/2011 | Dorn |
| 2012/0231191 | A1 | 9/2012 | Siegl |
| 2012/0248003 | A1 | 10/2012 | Hunter et al. |
| 2013/0140264 | A1 | 6/2013 | Hanan |
| 2013/0213925 | A1 | 8/2013 | Forsthovel et al. |
| 2014/0183202 | A1 | 7/2014 | Hanan |

FOREIGN PATENT DOCUMENTS

| | | | |
|---|---|---|---|
| DE | 202008012290 | U1 | 11/2008 |
| FR | 2846946 | A1 | 5/2004 |
| FR | 2899204 | A1 | 10/2007 |
| JP | S5632016 | U | 3/1981 |
| JP | 7164436 | A | 6/1995 |
| JP | 9240647 | A | 9/1997 |
| JP | 10029614 | A | 2/1998 |
| JP | 0068095 | A1 | 1/2000 |
| JP | 2004090425 | A | 3/2004 |
| JP | 2006016076 | A | 1/2006 |
| JP | 2008189721 | A | 8/2008 |
| JP | 2009045877 | A | 3/2009 |
| JP | 2010036942 | A | 2/2010 |
| WO | WO2004080828 | A1 | 9/2004 |
| WO | WO2006005413 | A1 | 1/2006 |
| WO | WO2006027092 | A1 | 3/2006 |
| WO | WO2006067590 | A1 | 6/2006 |
| WO | WO2007033722 | A1 | 3/2007 |
| WO | WO2007124894 | A1 | 11/2007 |
| WO | WO2011160748 | A1 | 11/2007 |
| WO | WO2008130987 | A1 | 10/2008 |
| WO | WO2012095285 | A1 | 12/2011 |
| WO | WO2012156048 | A1 | 7/2012 |
| WO | WO2013/085919 | | 6/2013 |
| WO | WO2014105956 | A1 | 6/2013 |

OTHER PUBLICATIONS

International Search Report with Written Opinion for related Application No. PCT/US2013/077810 dated Feb. 26, 2014 (11 Pages).
Examination Report issued from the Australian Patent Office for related Application No. 2019250198 dated Nov. 6, 2020 (4 Pages).

* cited by examiner

SWIRL BELL BOTTLE WITH WAVY RIBS

PRIORITY

This application is a continuation application which claims priority to U.S. patent application Ser. No. 14/610,940 filed on Jan. 30, 2015, continuation in part of, and claims the benefit of, U.S. patent application Ser. No. 14/157,400, entitled "Plastic Container With Strapped Base," filed on Jan. 16, 2014, which is a continuation in part of, and claims the benefit of, U.S. patent application Ser. No. 14/141,224, entitled "Plastic Container with Strapped Base," filed on Dec. 26, 2013, which claims the benefit of U.S. Provisional Application No. 61/746,535, filed on Dec. 27, 2012. This application also claims the benefit of U.S. patent application Ser. No. 13/705,040, entitled "Plastic Container with Varying Depth Ribs," filed on Dec. 4, 2012, now U.S. Pat. No. 8,556,098, entitled "Plastic Container Having Sidewall Ribs with Varying Depth," which claims benefit to U.S. Provisional Patent Application Ser. No. 61/567,086, entitled "Plastic Container with Varying Depth Ribs," filed on Dec. 5, 2011. Each of the aforementioned applications is incorporated by reference in its entirety into this application.

FIELD

This invention relates to plastic bottles and preforms, more specifically plastic performs and bottles blown from such preforms that are suitable for containing beverages and utilize less resin such that they are lighter in weight than conventional bottles.

BACKGROUND

Plastic containers have been used as a replacement for glass or metal containers in the packaging of beverages for several decades. The most common plastic used in making beverage containers today is polyethylene terephthalate (PET). Containers made of PET are transparent, thin-walled, and have the ability to maintain their shape by withstanding the force exerted on the walls of the container by their contents. PET resins are also reasonably priced and easy to process. PET bottles generally are made by way of a process that includes blow-molding of plastic preforms which have been made by injection molding of PET resin.

Advantages of plastic packaging include lighter weight and decreased breakage as compared to glass, as well as lower costs overall when taking both production and transportation into account. Although plastic packaging is lighter in weight than glass, there is still great interest in creating the lightest possible plastic packaging so as to maximize the cost savings in both transportation and manufacturing by making and using containers that contain less plastic.

SUMMARY

The bottling industry is moving in the direction of removing auxiliary packaging from cases or pallets. A case of bottles with film only and no paperboard is called a "film only conversion" or "lightweighting" of auxiliary packaging. The removal of supporting elements such as paperboard places additional stress on a bottle, which increases the structural demands on the bottle. In certain embodiments, a bottle design can provide one or more of the benefits of reducing bending and point loading failures. The disclosed design embodiments can alleviate the stresses during shipping and handling (including film only packaging) while maintaining ease of blow-molding. In certain embodiments, a bottle design uses less resin for the same or similar mechanical performance, resulting in a lightweight product.

Embodiments of the bottle disclosed herein may use polyethylene terephthalate (PET), which has viscoelastic properties of creep and relaxation. As a plastic, PET and other resins tend to relax at temperatures normally seen during use. This relaxation is a time dependent stress relieving response to strain. Bending can provide exaggerated strains over what would be seen in tensile loading. Due to exaggerated strains, the relaxation in bending can be much more severe. Bending happens at multiple length scales. Bending can happen at the length scale of the bottle or on a small length scale. An example of the bottle length scale bending is a person bending the bottle in his/her hands, or bending experienced during packing in a case on a pallet. An example of the small scale is the flexing or folding of ribs or other small features on the wall of the bottle. In response to loads at the first, larger length scale, ribs flex at the local, smaller length scale. When they are held in this position with time, the ribs will permanently deform through relaxation.

Further, embodiments of the bottles disclosed herein may undergo pressurization. Pressure inside a bottle can be due to the bottle containing a carbonated beverage. Pressure inside a bottle can be due to pressurization procedures or processes performed during bottling and packaging. For example, a bottle can be pressurized to help the bottle retain its shape. As another example, the bottle can be pressurized with certain gases to help preserve a beverage contained in the bottle.

Embodiments of the bottles disclosed herein have varying depth ribs that achieve a balance of strength and rigidity to resist the bending described above while maintaining hoop strength, such as, for example, when pressure is not used or relieved. A collection of flattened and/or shallow depth ribs act as recessed columns in the body of the bottle that distribute bending and top load forces along the wall to resist leaning, stretching, and crumbling. The collection of flattened and/or shallow depth ribs can help the bottle retain its shape during pressurization, such as, for example, help inhibit stretching of the bottle when pressurized. Inhibiting stretching of the bottle helps retain desired bottle shape to aid in packaging of the bottles as discussed herein by, for example, maintaining a substantially constant height of the bottle. Inhibiting stretching of the bottle can help with applying a label to a label portion of the bottle. For example, with a label applied to a bottle, inhibiting stretching of the bottle helps retain a constant length or height of the bottle at the label panel portion, which can help prevent tearing of the label and/or prevent the label from at least partially separating from the bottle (i.e., failure of the adhesive between the bottle and the label). Further details on the features and functions of varying depth ribs are disclosed in U.S. patent application Ser. No. 13/705,040, entitled "Plastic Container with Varying Depth Ribs," filed on Dec. 4, 2012, now U.S. Pat. No. 8,556,098, entitled "Plastic Container Having Sidewall Ribs with Varying Depth," which claims benefit to U.S. Provisional Patent Application Ser. No. 61/567,086, entitled "Plastic Container with Varying Depth Ribs," filed on Dec. 5, 2011, the entirety of each of which is incorporated herein by reference and made a part of this disclosure.

A balance may be achieved between flattened and/or shallow ribs and deep ribs to attain a desired resistance to bending, leaning, and/or stretching while maintaining stiffness in a lightweight bottle. In some embodiments, at least some of the aforementioned desired qualities may be further achieved through a steeper bell portion of a bottle. A steeper bell portion can increase top load performance in a lightweight bell. A lightweight bottle body and bell leaves more resin for a thicker base of the bottle, which can increase stability. A thicker base may better resist bending and top load forces and benefits designs with a larger base diameter with respect to the bottle diameter for tolerance even when the base is damaged during packaging, shipping, and/or handling.

Embodiments disclosed herein have a multiplicity of strap ribs that can function as straps from a base to a sidewall of the bottle to the help further achieve resistance to bending, leaning, stretching and/or flexing while maintaining stiffness. A strap rib on a base helps the base resist deformation under pressure without necessitating the base being overly heavy in weight relative to the lightweight bottle (i.e., relative to wall thickness of flat foot base that does not resist pressure as well). The strap base rib can be incorporated into a flat foot base. A flat foot base helps retain base foot thickness. Retaining base foot thickness helps retain bottle integrity during packaging and handling using lightweight packaging, such as, for example, film only packaging that requires the base to directly resist forces, including bending and point loading, during packaging, shipping, and/or handling. A flat foot base performs well with or without internal pressure due to, for example, the ability to maintain relative foot thickness in the base in a lightweight bottle. Without strap ribs, the base may have little internal pressure resistance and may rollout (pop out and create a rocker bottom). The strap ribs help resist damage and deformation as discussed herein without requiring a relatively heavy footed base. Without requiring a relatively heavy footed base, less material is needed for the lightweight bottle. Further, the strapped base design may allow for a relatively easier blowing process than other known pressure bases. Thus, a base with strap ribs as disclosed herein provides for a material efficient, pressure optional bottle base.

Incorporating strap ribs into the base with column formations in the sidewall of the bottle as discussed herein offers pressure resistance for internally pressurized bottles while maintaining strength and performance (i.e., resistance to bending and leaning) when without internal pressure (i.e., pressure release by a user opening a closure of a bottle). The strap ribs can cooperate with the column formations on the sidewall of the bottle to form straps around the bottle to communicate stresses along the height of the bottle.

The base with strap ribs helps maintain strength and performance of the column formations for internally pressurized bottles. With strap ribs, resistance to bending, leaning, and/or stretching while maintaining stiffness and hoop strength is maintained without pressure while enhancing these characteristics when the bottle is pressurized. For example, strap ribs allow the utilization of a flat foot base for better base strength during processing at a plant (i.e., adding beverage contents), while preventing rollout or popping out of the base during pressurization. Rollout of the base of the bottle leads to what may be called a "rocker bottom." Preventing rollout of the base helps the bottle stay level when resting on a surface and maintains the flat feet as the contact points on the surface. Further, base rollout can also occur without pressurization or low pressurization of the bottle, such as, for example, during shipping and handling or filling at high speed. Strap base ribs also help prevent base rollout without or low internal pressurization. While the specification herein may discuss preventing or inhibiting deformation under external/internal pressures and/or forces, it is to be understood that some deformation of a bottle may occur without straying outside of the scope of this disclosure. Some deformation of the bottle under external/internal pressures and/or forces may occur while retaining excellent structural properties of the features and functions disclosed herein.

Embodiments disclosed herein can be utilized for bottle pressures of a wide range. The strap base rib can help resist pressurization pressures in the bottle of up to 3 bars, including up to 2.5, up to 2, up to 1.5, up to 1, up to 0.5 bars, and up to 0.3 bars, including ranges bordered and including the foregoing values. The preform design also plays a role in resisting pressures such that much higher pressures than already demonstrated can be resisted with greater strap thickness available from the preform. The strap design provides a more efficient way of resisting the pressure in a bottle that also performs well without pressure.

Embodiments disclosed herein can be utilized in bottle volumes of a wide range. For example, features and functions disclosed herein can be utilized with a 3 ounce bottle up to a multiple gallon bottle. As another example, features and functions disclosed herein can be utilized with an 8 ounce (0.24 liter/0.15 liter) bottle up to a 3 liter bottle, including 12 ounces (0.35 liters) to 2 liters, 16 (0.47 liters) ounces to 1 liter, 18 ounces (0.53 liters) to 0.75 liters, and 0.5 liters, including ranges bordered and including the foregoing values.

Further, a new approach which relies on a general change in preform design, which significantly improves the ability to blow efficient, lightweight bottles is disclosed herein. The design elegantly incorporates features for protecting critical dimensions of the bottle and stabilizing the production blowing process. These features may also utilize less resin while achieving suitable mechanical performance resulting in a reduction in the use of petroleum products by the industry.

In an exemplary embodiment, a container comprises a base, a bell, a sidewall between the base and the bell, a neck and a finish which define an opening to an interior of the container, and a shoulder between the sidewall and the bell. The container further comprises a grip portion of the sidewall comprising a multiplicity of circumferentially positioned grip portion ribs; a label portion of the sidewall comprising a multiplicity of circumferentially positioned label portion ribs; a plurality of strap ribs, wherein each of the strap ribs extends substantially from a central portion of the base and terminates at a sidewall end in the grip portion, and wherein the strap ribs cooperate with a plurality of vertically aligned recessed columns of the sidewall so as to resist at least one of bending, leaning, crumbling, or stretching along the sidewall and the base; a plurality of inwardly offset portions of the sidewall configured to resist outward bowing of the sidewall due to internal pressure of contents in the interior of the container, each of the plurality of inwardly offset portions being disposed between each pair of adjacent vertically aligned recessed columns; a plurality of load ribs spaced equally between adjacent strap ribs, wherein the load ribs are configured to resist deformation of the base; and a plurality of feet formed between the strap ribs and the load ribs, wherein the plurality of feet comprises a resting surface of the container.

In another exemplary embodiment, the plurality of vertically aligned recessed columns comprises three recessed columns equally spaced around the perimeter of the sidewall, such that the sidewall comprises a circumference which is offset from a generally circular cross-sectional shape to a substantially triangular cross-sectional shape. In another exemplary embodiment, each of the plurality of inwardly offset portions is offset from 0 to 30 degrees from the circular cross-sectional shape. In another exemplary embodiment, the plurality of inwardly offset portions is configured to counteract outward-directed forces on the sidewall of the container due to internal pressure, such that the pressurized container assumes a substantially circular cross-sectional shape.

In another exemplary embodiment, the base comprises a diameter which is larger than a diameter of the shoulder, such that the base creates a single point of contact with other substantially similar containers in a production line, or in packaging. In another exemplary embodiment, the diameter of the base is larger than the diameter of the shoulder by 0.5 to 4 millimeters. In another exemplary embodiment, the diameter of the base is larger than the diameter of the shoulder by 1 to 2 millimeters.

In another exemplary embodiment, the plurality of strap ribs comprises three strap ribs equally spaced around the circumference of the base, and wherein the plurality of load ribs comprises six load ribs, such that two load ribs are equally spaced between each pair of adjacent strap ribs. In another exemplary embodiment, the base further comprises a gate centered on a longitudinal axis of the container, a wall extending from the gate toward the resting surface of the container, and a dome immediately surrounding the gate, wherein the dome is a portion of the wall of the base that slopes more steeply toward the resting surface of the container. In another exemplary embodiment, each of the strap ribs has a base end which terminates in the dome, near the periphery of the gate. In another exemplary embodiment, each of the strap ribs begins at the base end substantially parallel to the resting surface of the container and then extends along an upward curved path, a first portion of the upward curved path comprising a first radius, a second portion of the upward curved path comprising a second radius, and a third portion of the upward curved path comprising a straight portion, wherein at a first height the first radius terminates and the second radius begins, and at a second height the straight portion connects to the sidewall end of the strap rib, and wherein the first radius and the second radius cooperate to give the strap rib and the base a spherical configuration, such that the container better accommodates internal pressure. In another exemplary embodiment, each of the strap ribs further comprises two rib side walls that connect the strap rib to portions of the base and the feet, the rib side walls comprising smooth and gradual transitions into the base and the feet, such that the transitions comprise spherical features of the container.

In an exemplary embodiment, a container configured to substantially reduce triangulation of the container due to internal pressure of contents within the container, comprises a base which extends upward to a sidewall of the container; a shoulder connected between the sidewall and a bell, a diameter of the bell decreasing as the bell extends upward to a neck of the container; a finish connected to the neck, the finish configured to receive a closure and defining an opening to an interior of the container; and a plurality of inwardly offset portions of the sidewall configured to resist outward bowing of the sidewall due to the internal pressure of the contents.

In another exemplary embodiment, the sidewall comprises a plurality of vertically aligned recessed columns configured to resist the internal pressure of the contents. In another exemplary embodiment, the plurality of vertically aligned recessed columns comprises three recessed columns disposed uniformly around the circumference of the sidewall, and wherein one inwardly offset portion is disposed between each pair of adjacent recessed columns, such that the circumference of the sidewall is offset from a generally circular cross-sectional shape to a substantially triangular cross-sectional shape. In another exemplary embodiment, each of the inwardly offset portions is offset from 0 to 30 degrees from the circular cross-sectional shape. In another exemplary embodiment, the inwardly offset portions are configured to counteract outward-directed forces on the sidewall of the container due to internal pressure, such that the pressurized container assumes a substantially circular cross-sectional shape.

In another exemplary embodiment, the base comprises a diameter which is larger than a diameter of the shoulder, such that the base creates a single point of contact with other substantially similar containers in a production line, or in packaging. In another exemplary embodiment, the diameter of the base is larger than the diameter of the shoulder by 0.5 to 4 millimeters. In another exemplary embodiment, the diameter of the base is larger than the diameter of the shoulder by 1 to 2 millimeters.

BRIEF DESCRIPTION OF THE DRAWINGS

The drawings refer to embodiments of the present invention in which.

Figure 1:
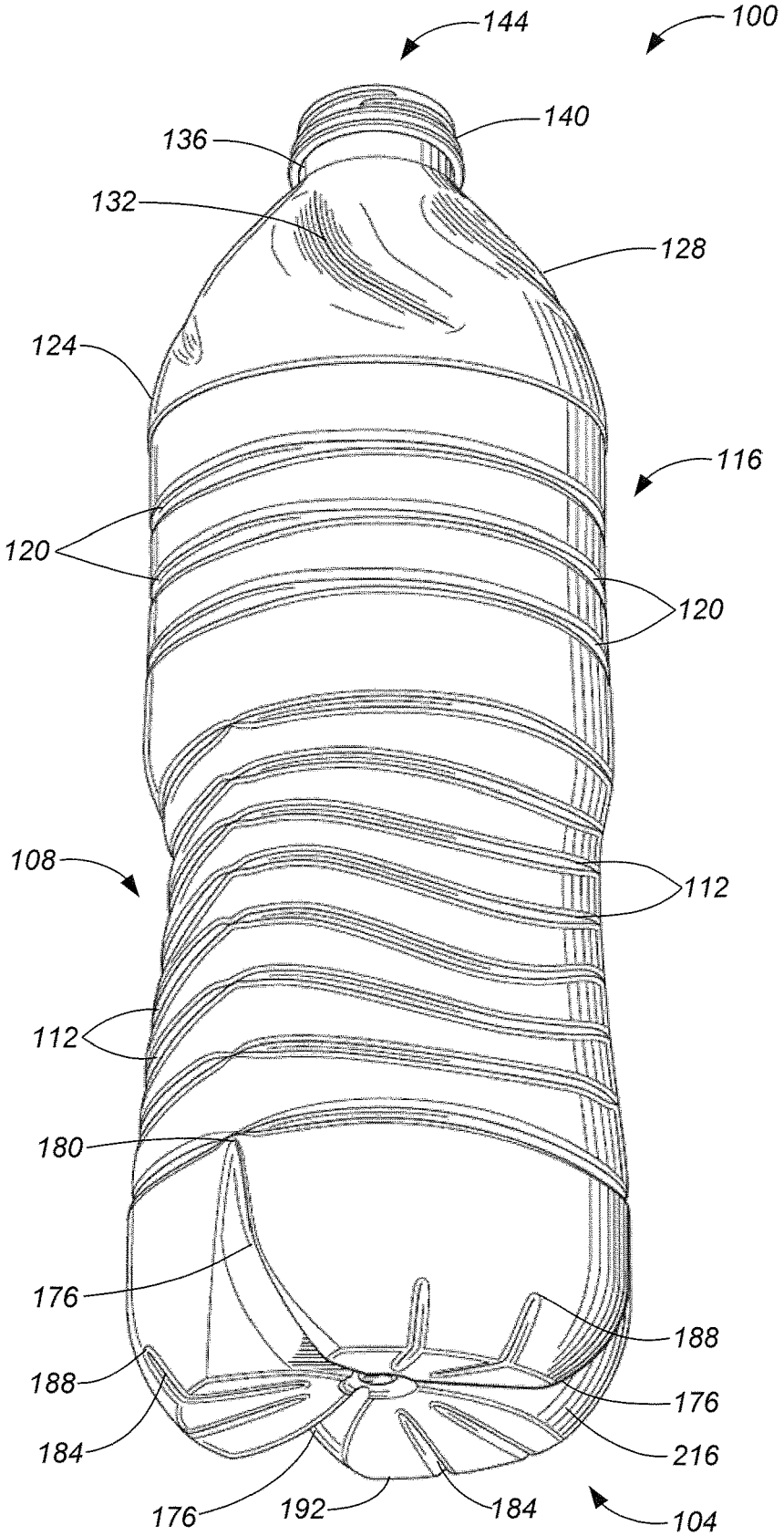
FIG. 1 illustrates a lower perspective view of an exemplary embodiment of a container in accordance with the present disclosure.
Figure 2:
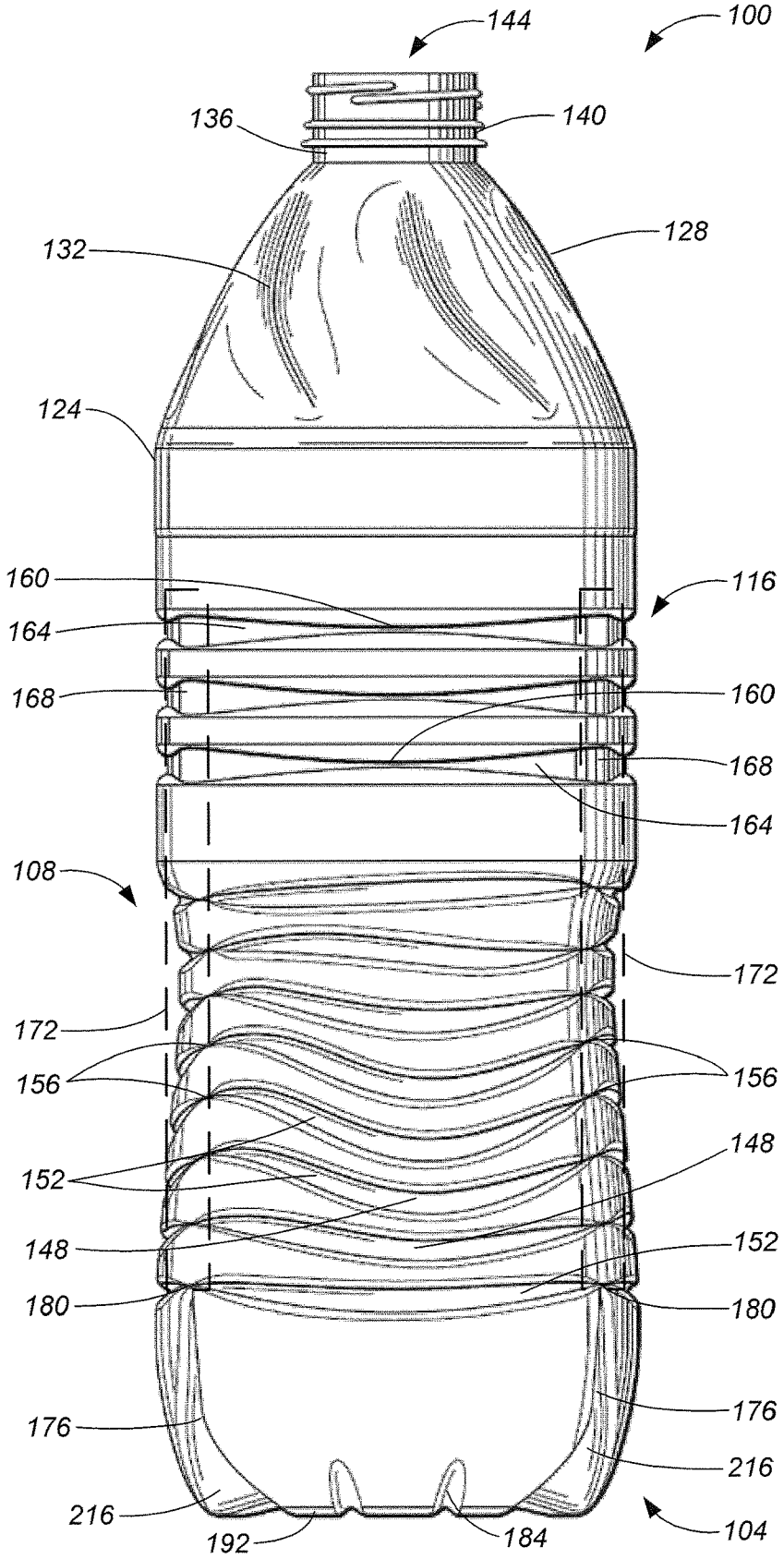
FIG. 2 illustrates a front elevation view of an exemplary embodiment of a container, according to the present disclosure.

While the present invention is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present invention.

DETAILED DESCRIPTION

In the following description, numerous specific details are set forth in order to provide a thorough understanding of the present invention. It will be apparent, however, to one of ordinary skill in the art that the present invention may be practiced without these specific details. In other instances, specific numeric references such as "first load rib," may be made. However, the specific numeric reference should not be interpreted as a literal sequential order but rather interpreted that the "first load rib" is different than a "second load rib." Thus, the specific details set forth are merely exemplary. The specific details may be varied from and still be contemplated to be within the spirit and scope of the present invention. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, the present disclosure provides an apparatus for a container comprising a base, a bell, a sidewall between the base and the bell, a neck and a finish which define an opening to an interior of the container, and a shoulder between the sidewall and the bell. In one embodiment, the base comprises a diameter which is larger than a diameter of the shoulder, such that the base creates a single point of contact with other substantially similar containers in a production line, or in packaging. In some embodiments, the diameter of the base is larger than the diameter of the shoulder by 0.5 to 4 millimeters, and preferably by 1 to 2 millimeters. Strap ribs extend from a central portion of the base and terminate at the sidewall. The strap ribs cooperate with vertically aligned recessed columns of the sidewall to resist bending, leaning, crumbling, or stretching along the sidewall and the base. An inwardly offset portion of the sidewall is disposed between each pair of adjacent recessed columns. In one embodiment, three recessed columns are equally spaced around the perimeter of the sidewall, such that the sidewall comprises a circumference which is offset from a generally circular cross-sectional shape to a substantially triangular cross-sectional shape. In one embodiment, each of the inwardly offset portions is offset from 0 to 30 degrees from the circular cross-sectional shape. The inwardly offset portions of the sidewall are configured to resist outward bowing of the sidewall due to internal pressure of contents within the container.

FIG. 1 illustrates a bottom perspective view of an exemplary embodiment of a container 100 in accordance with the present disclosure. The container 100 comprises a base 104 that extends up to a grip portion 108. The grip portion 108 comprises a plurality of grip portion ribs 112 (i.e., sidewall ribs). As illustrated in FIG. 1, the plurality of grip portion ribs 112 generally vary in depth, and swirl or angulate around the grip portion 108. A label portion 116 is connected to the grip portion 108 and comprises one or more label panel ribs 120 (i.e., sidewall ribs). The label panel portion 116 transitions into a shoulder 124, which connects to a bell 128. In the embodiment illustrated in FIG. 1, the bell 128 comprises a plurality of design features 132. In other embodiments, however, the bell 128 may include various other design features, or may be smooth and generally unornamented. The bell 128 connects to a neck 136, which connects to a finish 140. As shown in FIG. 1, the bell 128 comprises a diameter that generally decreases as the bell 128 extends upward from the shoulder 124 to the neck 136 and the finish 140. The finish 140 is adapted to receive a closure, such as by way of non-limiting example, a container cap or bottle cap, so as to seal contents within the container 100. The finish 140 generally defines an opening 144 that leads to an interior of the container 100 for containing a beverage, or other contents, such as any of a variety of carbonated soft drinks.

A substantially vertical sidewall comprising the grip portion 108 and the label portion 116 between the base 104 and the bell 128, extending substantially along a longitudinal axis of the container 100, and defines at least part of the interior of the container 100. In some embodiments, the sidewall may include the bell 128, the shoulder 124, and/or the base 104. A perimeter (i.e., periphery) of the sidewall is substantially perpendicular to the longitudinal axis of the container 100. The finish 140, the neck 136, the bell 128, the shoulder 124, the label portion 116, the grip portion 108, and the base 104 each comprises a respective perimeter (i.e., periphery) which is substantially perpendicular to the longitudinal axis of the container 100. For example, the label portion 116 comprises a label portion perimeter, whereas the grip portion 108 comprises a grip portion perimeter, both of which perimeters being substantially perpendicular to the longitudinal axis of the container 100.

Figure 3:
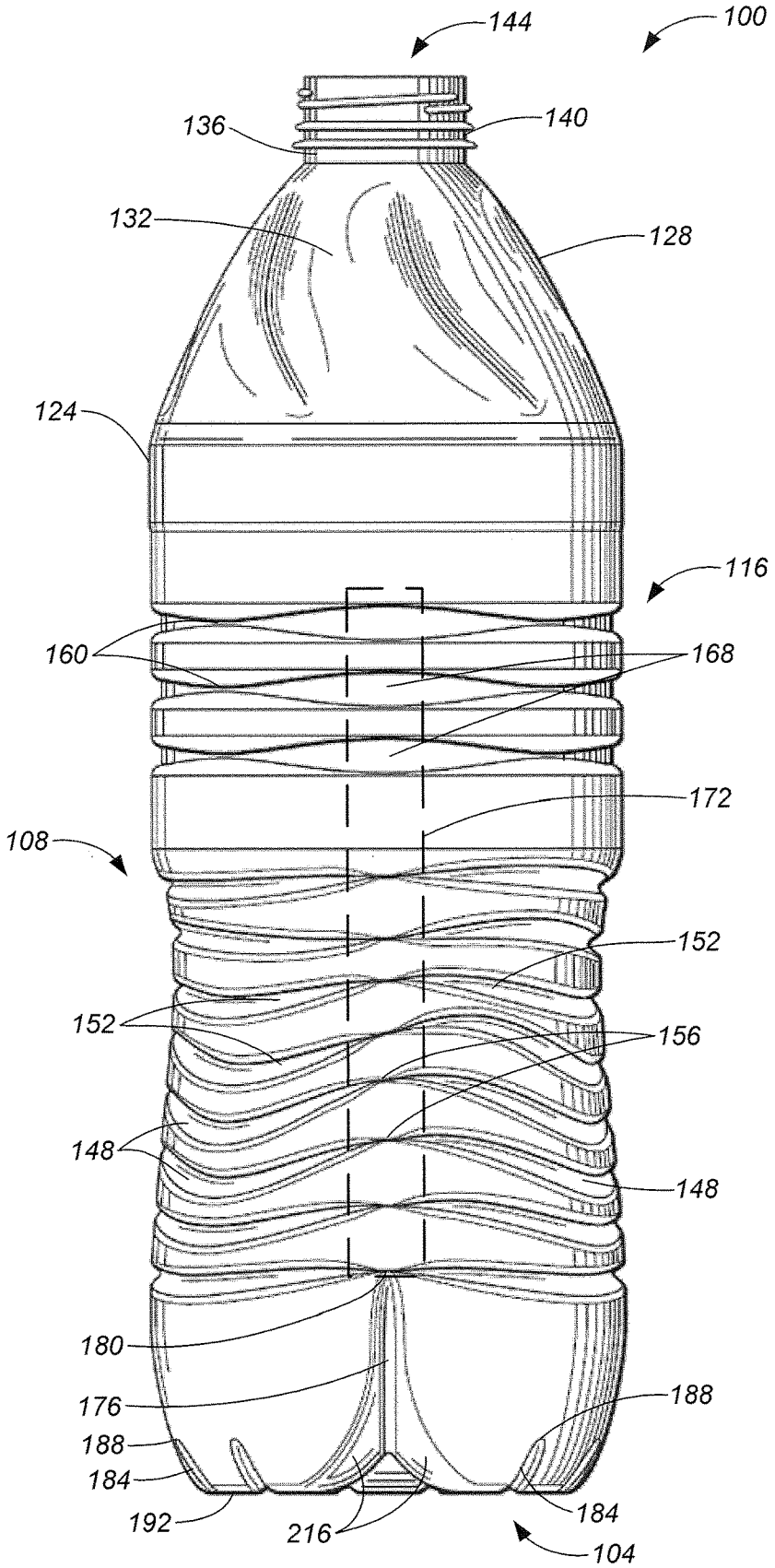
FIG. 3 illustrates a rear elevation view of an exemplary embodiment of a container in accordance with the present disclosure.

In the embodiment illustrated in FIGS. 1-5, each grip portion rib 112 comprises a deep rib portion 148 transitioning to a middle rib portion 152 and then transitioning to a shallow rib portion 156. Similarly, each label portion rib 120 comprises a deep rib portion 160 transitioning to a middle rib portion 164 and then transitioning to a shallow rib portion 168. The deep, middle, and shallow rib portions may also be referred to as deep, middle, and shallow ribs as a shorthand, but it is to be understood that these terms are intended to define portions of each rib in the grip portion 108 and the label portion 116. In the embodiment illustrated in FIGS. 1-5, the shallow rib portions 156, 168 are vertically aligned with the longitudinal axis of the container 100. As best illustrated in FIG. 3, the shallow rib portions 156, 168 form an equivalent of recessed columns 172 at portions where the shallow rib portions 156, 168 substantially vertically line up along the longitudinal axis of the container 100. Further, the deep rib portions 148, 160 are substantially vertically aligned along the vertical or longitudinal axis of the container 100. Thus, the embodiment illustrated in FIGS. 1-5 comprises three recessed columns 172 and three portions where the deep rib portion 148, 160 are substantially vertically aligned.

In some embodiments, the shallow rib portions 168 of the label portion 116 may be vertically misaligned with the shallow rib portions 156 of the grip portion 108, such that the label portion 116 has a first set of recessed columns and the grip portion 108 has a second set of recessed columns. In some embodiments, the container 100 may have recessed columns solely in the grip portion 108 or solely in the label panel portion 116.

In the illustrated embodiment of FIGS. 1-5, the three recessed columns 172 are equally spaced apart around the perimeter of the container 100 and located on an opposite sides of the container perimeter from the deep rib portions 148, 160. It will be appreciated that with three equally spaced recessed columns 172, the recessed columns 172 are spaced substantially every 120 degrees around the circumference of the container 100. Any number of recessed columns 172 may be incorporated into a design of the container 100 by either increasing or decreasing the number of shallow rib portions 156, 168 that are substantially vertically aligned along the longitudinal axis of the container 100. For instance, other embodiments of the container 100 may comprise a number of the recessed columns 172 ranging between 1 and 10 recessed columns.

In some embodiments, the label portion 116 may comprise a different number of recessed columns 172 than the grip portion 108. For example, the label portion 116 may comprise six equally spaced recessed columns, wherein three are vertically aligned with the recessed columns 172 of the grip portion 108 while the remaining three recessed columns are limited to the label portion 116. With six equally spaced recessed columns around the perimeter of the label portion 116, the recessed columns are positioned every 60 degrees around the circumference of the container 100. More recessed columns can help prevent triangulation of the label portion 116. As will be appreciated, shallow rib portions coupled with recessed columns better resists radial outward flexing, at least partially because the shallow rib portions possess a relatively smaller radial depth available for flexing. Correspondingly, shallow rib portions coupled with recessed columns provides a greater resistance to internal pressure relative to deep rib portions. Thus, incorporating more frequent shallow rib portions and/or recessed columns around the circumference of the container 100 helps inhibit outward triangulation of the container due to internal pressure of contents within the container.

The vertical alignment of the shallow rib portions 156, 168 that foil the recessed columns 172 provides resistance to leaning, load crushing, and/or stretching of the container 100. Leaning can occur when, during and/or after bottle packaging, a bottle, such as the container 100, experiences top load forces (tangential forces or otherwise) from other bottles and/or other objects stacked on top of the container. Similarly, top load crushing can occur due to vertical compression (or otherwise) forces from bottles and/or other objects stacked on top. Stretching can occur when the container is pressurized. The recessed columns 172 transfer the resulting forces along the sidewall of the container 100 to the base 104 and thus increase rigidity of the container 100. The deep rib portions 148, 160 of the grip portion ribs 112 and label panel ribs 120, respectively, provide a hoop strength that can be equivalent to the hoop strength imparted by ribs comprising a uniform depth. The number of ribs, including the grip portion ribs 112, and/or the label panel ribs 120 may vary between 1 and 30 ribs positioned, for example, every 10 centimeters along any rib-containing portion of the container 100, such as, but not necessarily limited to the grip portion 108 and/or the label portion 116. It should be understood that the aforementioned 10-centimeters that is used to measure the number of ribs in a portion of the container need not be actually 10 centimeters in length, but rather the 10-centimeters is used illustratively to provide a relationship between the number of ribs incorporated into a given length of a portion of the container.

As discussed above, the three recessed columns 172 operate to prevent outward triangulation of the sidewall of the container 100, wherein the shallow rib portions 156, 168 coupled with the recessed columns 172 better resists radial outward flexing of the sidewall of the container 100. Preferably, the portions of the sidewall between the recessed columns 172 are bowed inward, or offset, toward the interior of the container 100, such that the perimeter of the sidewall is offset from a generally circular cross-sectional shape to a substantially inwardly triangular cross-sectional shape. In some embodiments, the offset portions of the sidewall may be offset from 0 to 30 degrees from the circular cross-sectional shape. The offset portions of the sidewall are configured to resist outward bowing of the sidewall due to internal pressure when the container 100 is filled with contents, particularly carbonated contents. It is envisioned that outward-directed forces on the sidewall of the container 100 due to internal pressure are counteracted by inward-directed resistance forces produced by the offset portions, such that the pressurized container assumes a substantially circular cross-sectional shape rather than becoming outwardly triangulated, as discussed herein. Thus, incorporating inwardly offset portions between the recessed columns 172 around the perimeter of the container 100 further inhibits outward triangulation of the container.

With reference to FIG. 1, the base 104 comprises three strap ribs 176. Each of the strap ribs 176 comprises a sidewall end 180 that terminates along the sidewall of the container 100, as discussed herein. Further, the base 104 comprises six load ribs 184. As illustrated in FIG. 1, two load ribs 184 are positioned between two strap ribs 176. In some embodiments, the base 104 may comprise a number of load ribs 184 ranging between 1 and 5 load ribs positioned between two strap ribs 176. Each of the load ribs 184 has a sidewall end 188 that terminates along the base 104 at a transition from the base 104 to the sidewall of the container 100. As illustrated in FIG. 1, the sidewall end 188 of the load rib 184 is vertically lower than the sidewall end 180 of the strap rib 176 along the longitudinal axis of the container 100. In some embodiments, the sidewall end 188 of the load rib 184 may terminate along the sidewall of the container 100 at a height which is substantially similar to the height of the sidewall end 180 of the strap rib 176. As further illustrated in FIG. 1, the base 104 comprises feet 192 formed between the strap ribs 176 and the load ribs 184.

The strap rib 176 is relatively larger and deeper than the load rib 184, as discussed herein. As illustrated in FIGS. 1-5, each of the strap ribs 176 is vertically aligned with one of the recessed columns 172, and thus the strap ribs 176 are spaced equally around the circumference of the container 100. It will be recognized that with three equally spaced strap ribs 176, the strap ribs 176 are positioned every 120 degrees around the container circumference. The load ribs 184 are vertically aligned with the grip portion ribs 112 between the recessed columns 172. In some embodiments, the strap ribs 176 may be vertically misaligned with the recessed columns 172. In some embodiments, the strap ribs 176 may be spaced unequally around the circumference of the container 100. In some embodiments, the base 104 may comprise more or less strap ribs 176 than the number of recessed columns 172. In some embodiments, the strap rib 176 may be vertically aligned with the deep rib portions 148, 160 and may terminate into a first deep rib portion 148 (first from the base 104). In some embodiments, the strap rib 176 may have a sidewall end 180 that terminates past the first shallow rib portion 156 and/or the first deep rib portion 148, such as for example at the second, third, and/or fourth grip portion ribs 112.

FIG. 3 illustrates a rear elevation view of the container 100. As shown in FIG. 3, the sidewall end 180 of the strap rib 176 vertically aligns with, or points to substantially the center of the recessed column 172, which is coincident with the center point of the shallow rib portion 156. As further illustrated in FIG. 3, the strap rib 176 forms a recess 196, which is relatively a small area in comparison to the contact area of the feet 192 with a resting surface. Utilizing a small recess 196 aids in distributing more resin toward the feet 192 during the blowing process, which generally increases the abrasion resistance and strength of the feet 192. Thus, the strap ribs 176 operate to provide internal pressure resistance while leaving enough resin for the feet 192 to achieve the benefits of a flat foot base (i.e., thicker resin feet 192 for greater abrasion, deformation, and/or stress resistance; and/or greater foot contact area for stability and load distribution).

Figure 7:
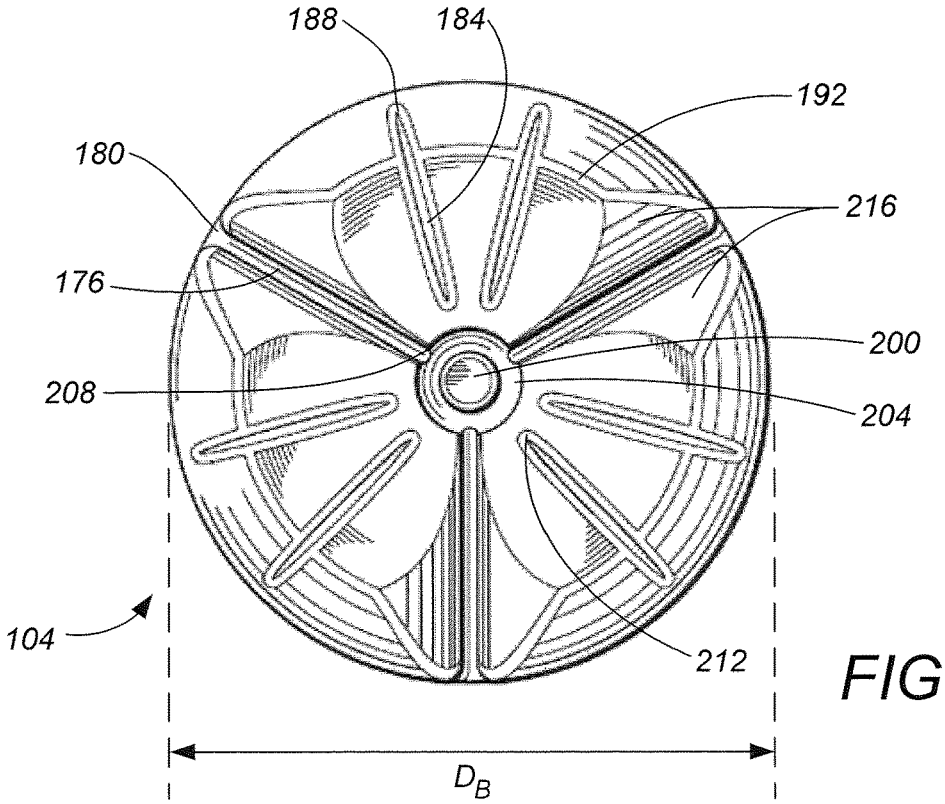
FIG. 7 illustrates a bottom plan view of an exemplary embodiment of a container in accordance with the present disclosure.

As best illustrated in FIG. 7, the strap ribs 176 extend substantially from a central portion of the base 104, coinciding with the longitudinal axis of the container 100, as discussed herein. As will be appreciated by those skilled in the art, the strap ribs 176 operate as a straps extending between the recessed columns 172 of the sidewall to the central portion of the base 104. As shown in FIG. 1, the strap rib 176 provides a more direct and shorter path from the center of the base 104 to the sidewall of the container 100 without proceeding to the vertical level of the feet 192. As discussed herein, the strap ribs 176 thus provide a relatively more pressure resistant base 104. Each of the strap ribs 176 provides a link for forces and stresses between the sidewall, including the recessed column 172, and the central portion of the base 104.

Figure 8:
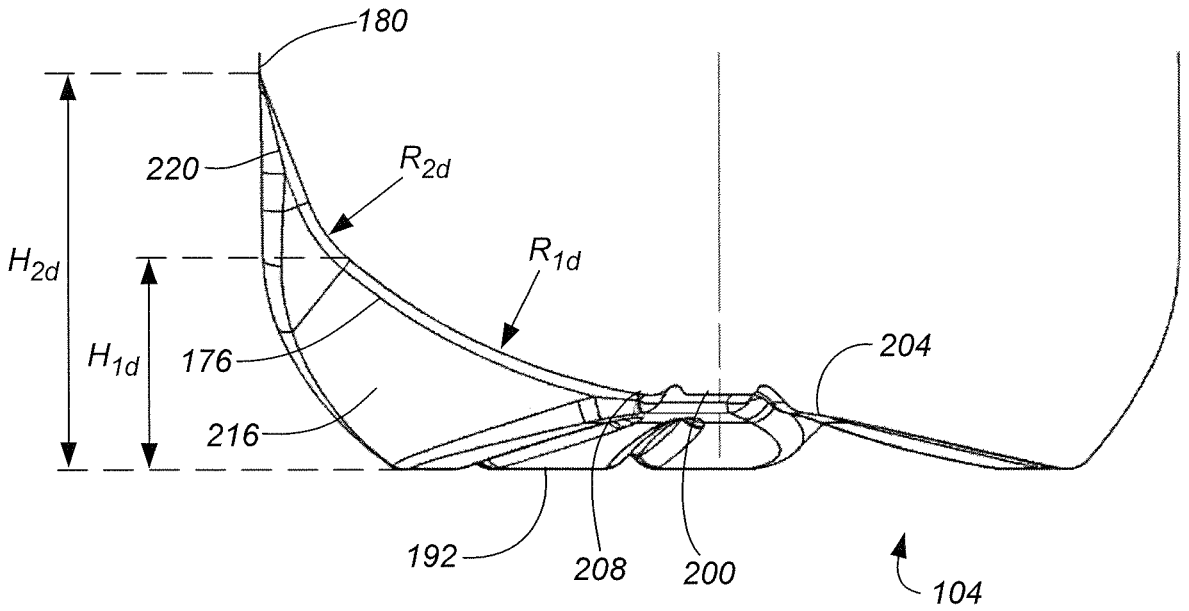
FIG. 8 illustrates a cross-sectional view along a longitudinal axis of an exemplary embodiment of a base of a container, according to the present disclosure.

FIG. 8 illustrates a cross-sectional view along the longitudinal axis of the base 104 of the container 100. As shown in FIG. 8, the strap rib 176 of the base 104 begins at a base end 212 substantially parallel to a resting surface of the base 104 and then extends along a curved path, having a first radius $R_{1d}$, with an increasingly positive slope. At a height $H_{1d}$, the radius of the curved path of the strap rib 176 changes to a second radius $R_{2d}$ with an increasingly positive slope before extending into a straight portion 220. At a height $H_{2d}$, the straight portion 220 connects to the sidewall end 180 as discussed herein. The first and second radii $R_{1d}$, $R_{2d}$, as well as the corresponding positive slopes and the heights $H_{1d}$ and $H_{2d}$, may have dimensional values falling within any of the appropriate ranges of values discussed in detail in U.S. patent application Ser. No. 14/157,400, entitled "Plastic Container With Strapped Base," filed on Jan. 16, 2014, the entirety of which is incorporated herein by reference and forms a part of the present disclosure. Preferably, however, the combination of the radii $R_{1d}$ and $R_{2d}$ cooperate to give the strap rib 176, and thus the base 104, a smooth and gradual, spherical configuration. As discussed herein, spherical features of the container 100 better accommodate internal pressure. Experimentation has demonstrated that the spherical configuration of the base 104 depicted in FIG. 1-5 is capable of withstanding an internal pressure at least twice the internal pressure tolerable by conventional base configurations.

It will be recognized that the strap rib 176 illustrated in FIG. 8 does not include a transition curve between the first radius $R_{1d}$ and the second radius $R_{2d}$, nor between the second radius $R_{2d}$ and the straight portion 220. In other embodiments, however, a transition curve having a radius other than $R_{1d}$ and $R_{2d}$ may be positioned between the curved portions of the strap rib 176 having radii $R_{1d}$ and $R_{2d}$. In still other embodiments, a transition curve may be positioned between the curved portion of the strap rib 176 having the second radius $R_{2d}$ and the straight portion 220. It is envisioned that the transition curves may have dimensional values that further produce a spherical configuration of the strap rib 176, and thus the base 104.

As illustrated in FIG. 7, the base 104 comprises a gate 200 surrounded by a dome 204. The dome 204 comprises a portion of a wall of the base 104 which slopes more steeply toward a resting surface when the bottle is placed on the resting surface relative to the rest of the wall of the base 104 leading to the feet 192. The strap rib 176 comprises a base end 208 that terminates substantially at a periphery of the dome 204. In some embodiments, the base end 208 of each strap rib 176 may be positioned outside of the dome 204 similarly to base ends 212 of the load ribs 184. Each of the strap ribs 176 comprises a pair of rib side walls 216 that connect the strap rib 176 to portions of the base 104 and the feet 192. The rib side wall 216 smoothly and gradually transitions into the base 104 and the feet 192. The smooth and gradual transition provides internal pressure resistance at and near the rib side wall 216 since more spherical features of the container 100 better accommodate internal pressure. The strap rib 176 is relatively deeper in the base 104 than the load rib 184 so as to provide stress transfer and pressure resistance, as discussed herein.

As mentioned above, each of the load ribs 184 comprises a base end 212 that terminates at, or near the dome 204. In the embodiment illustrated in FIG. 7, the base ends 212 of the load ribs 184 terminate before the base ends 180 of the strap ribs 176. Further, the load ribs 184 are shallow relative to the strap ribs 176. Accordingly, the load ribs 184 each comprises rib side walls that are relatively smaller than the rib side walls 216, and thus the transition from the load ribs 184 to the base 104 and the feet 192 is more abrupt, or sharper, than in the case of the rib side walls 216. It will be appreciated that when the container 100 is top loaded during packaging, shipping, and/or handling, the sharper transitions of the load ribs 184 resist bending and/or leaning as discussed herein by, for example, maintaining the integrity and shape of the base 104. Moreover, the sharper transitions of the load ribs 184 provide more area of the base 104 being available for relatively larger feet 192. It will be further appreciated that larger feet 192 of a flat-foot base, such as the base 104 discussed herein and as illustrated in FIG. 7, provide more resin contact area with a resting surface, and thus provide better abrasion resistance and stability of the base. As further illustrated in FIG. 7, the rib side walls 216 generally transition into the strap ribs 176 more abruptly, or sharply, relative to the transition from the rib side walls 216 to the feet 192. The sharper transitions to the strap ribs 176 provide more rigidity to the strap ribs so as to resist, or inhibit, flexing due to internal pressures.

In the embodiment of FIG. 7, the base ends 208 of the strap ribs 176 terminate substantially near the gate 200, and the base ends 212 of the load ribs 184 terminate near the periphery of the dome 204. It will be appreciated that terminating the base ends 208 of the strap ribs 176 and/or the base ends 212 of the load ribs 184 substantially near, or at the gate 200 provides greater internal pressure resistance to the base 104, as discussed herein, preventing, for example, base rollout. Moreover, terminating each of the base ends 208 substantially near, or at the gate 200 provides strap ribs 176 that are substantially continuous from (or near) the gate 200 to the sidewall ends 180. As shown in FIGS. 1-5, the sidewall ends 180 terminate at the first shallow rib portion 156 and communicate directly with the recessed columns 172. The continuity from the recessed columns 172 to the gate 200 provides substantially continuous pressure resistance bands, or straps, from a top of the label portion 116 to the gate 200. Pressure resistance straps that are substantially continuous provide greater resistance to internal pressure, as discussed herein.

Figure 6:
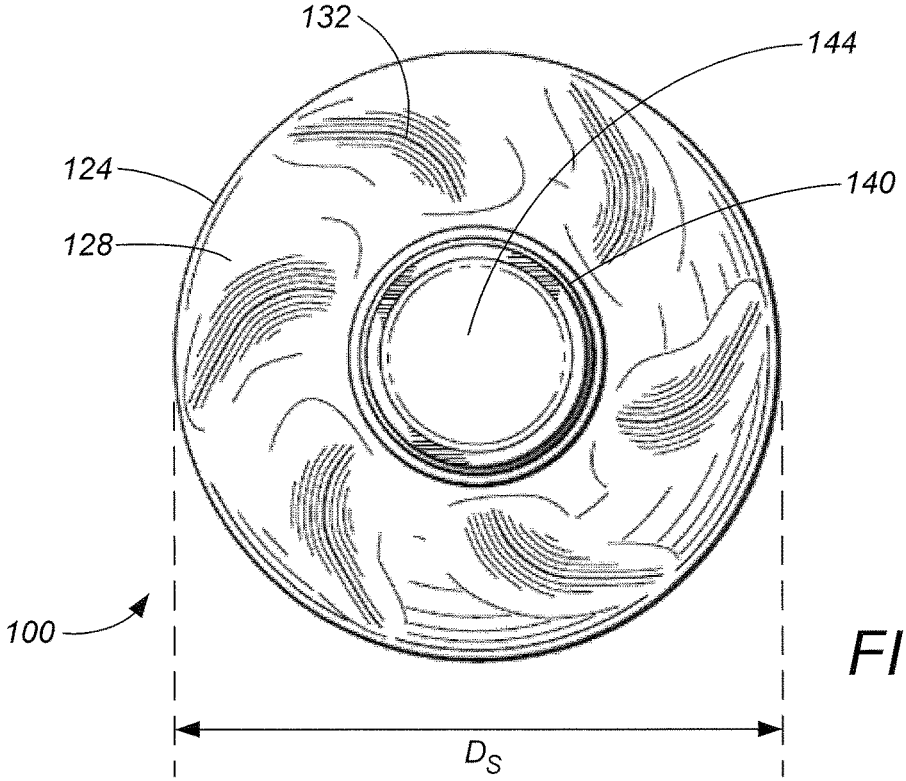
FIG. 6 illustrates a top plan view of an exemplary embodiment of a container, according to the present disclosure.

FIG. 6 illustrates a top plan view of the container 100, showing the shoulder 124, the bell 128 with the design features 132, the finish 140, and the opening 144 to the interior of the container. As illustrated in FIG. 6, the shoulder 124 comprises a diameter $D_S$. Similarly, in the embodiment of the base 104 illustrated in FIG. 7, the base 104 comprises a diameter $D_B$. The diameter $D_B$ of the base 104 preferably is larger than the diameter $D_S$ of the shoulder 124, such that the base 104 creates a single point of contact with other substantially similar containers in a production line, or in packaging. In some embodiments, the diameter $D_B$ of the base 104 is larger by 0.5 to 4 millimeters than any other diameter of the container 100, including the diameter $D_S$ of the shoulder 124. It will be appreciated that the larger base 104 diameter $D_B$ advantageously improves conveying a multiplicity of the container 100 in a production line. Further, the larger base 104 diameter $D_B$ advantageously improves stability when there is any damage to the base 104. In some embodiments, the diameter $D_S$ of the shoulder 124 may be equal to the diameter $D_B$ of the base 104, thereby providing two points of contact, at the shoulder 124 and the base 104, with other substantially similar bottles in a production line, or in packaging. It will be appreciated that where the diameter(s) of any portion of the container 100 varies, the largest diameters create points of contact with other substantially similar containers in a production line, or in packaging. Thus, the containers generally may have either a single point of contact or multiple points of contact.

Figure 4:
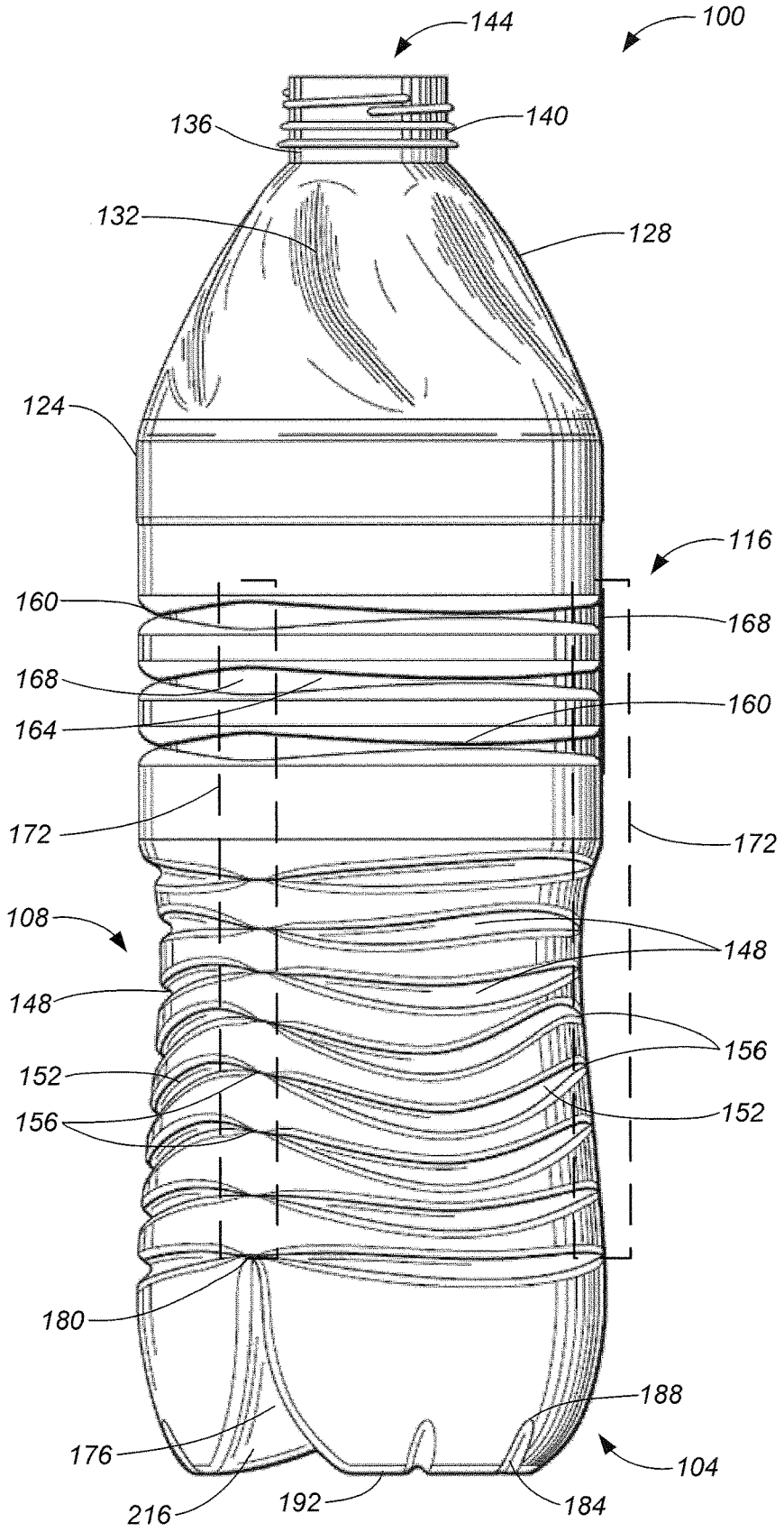
FIG. 4 illustrates a right side elevation view of an exemplary embodiment of a container, according to the present disclosure.
Figure 5:
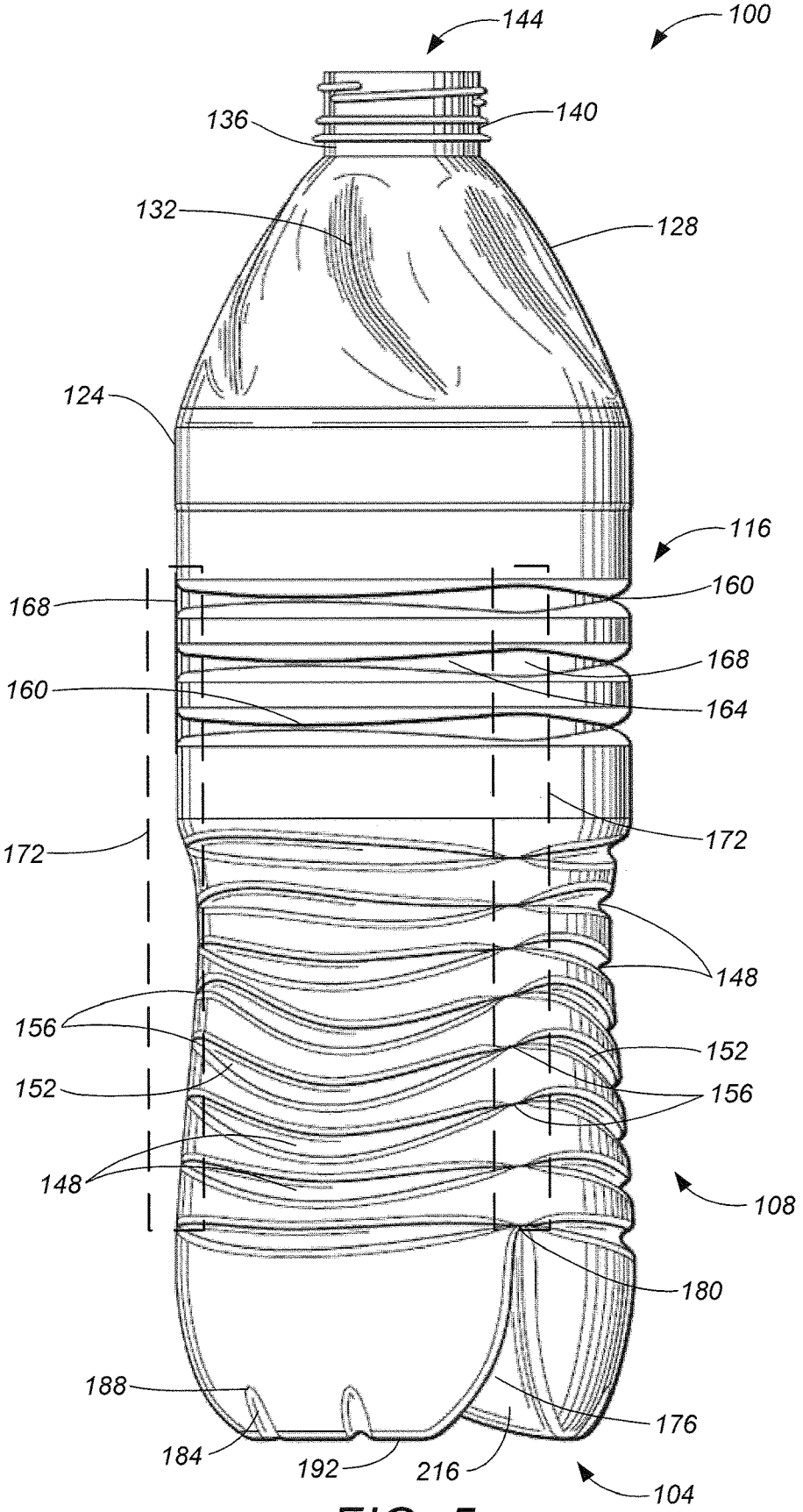
FIG. 5 illustrates a left side elevation view of an exemplary embodiment of a container in accordance with the present disclosure.

FIG. 4 illustrates a right side elevation view of container 100, which shows a plan view of the shallow rib portions 156, 168 along the right-hand side of the container 100 and a plan view of the deep rib portions 148, 160 along the left-hand side of the container 100. FIG. 5 illustrates a left side elevation view of container 100, which shows the shallow rib portions 156, 168 along the left-hand side of the container 100 and the deep rib portions 148, 160 along the right-hand side of the container 100. As discussed above in connection with FIG. 1, the deep rib portions 148, 160 comprise a depth which is larger than a depth of the middle rib portions 152, 164 which is larger than a depth of the shallow rib portions 156, 168. In some embodiments, a depth of the deep rib portions 148 may range from 1 to 10 millimeters. In some embodiments, a depth of the deep rib portions 160 may range from 0.5 to 10 millimeters. In some embodiments, a depth of the middle rib portions 152 may range from 0 to 5 millimeters. In some embodiments, a ratio of the depth of the deep rib portions 148 to the depth of the middle rib portions 152 may vary from 1:1 to 20:1.

In some embodiments, a depth of the shallow rib portions 156 may range from 0 to 2.5 millimeters. In some embodiments, a ratio of the depth of the deep rib portions 148 to the depth of the shallow rib portions 156 may vary from 1:1 to 100:1, including where the shallow rib portions 156 have zero depth, resulting in substantially an infinite ratio. In some embodiments, a ratio of the depth of the middle rib portions 152 to the depth of the shallow rib portions 156 may vary from 1:1 to 50:1, including where shallow rib portions 156 have zero depth, resulting in substantially an infinite ratio.

In some embodiments, a depth of the shallow rib portions 168 may vary from 0 to 2.5 millimeters. In some embodiments, a ratio of the depth of the deep rib portions 148 to the depth of the shallow rib portions 168 may vary from 1:1 to 100:1, including where the shallow rib portions 168 have zero depth, resulting in substantially an infinite ratio. In some embodiments, a ratio of the depth of the deep rib portions 160 to the depth of the shallow rib portions 168 may range from 1:1 to 100:1, including where the shallow rib portions 168 have zero depth, resulting in substantially an infinite ratio. In some embodiments, a ratio of the depth of the middle rib portions 152, 164 to the depth of the shallow rib portions 168 may vary from 1:1 to 50:1, including where the depth of the shallow rib portions 168 is zero, resulting in substantially an infinite ratio. In some embodiments, a ratio of the depth of the deep rib portions 160 to the depth of the shallow rib portions 168 may vary from 1:1 to 100:1, including a substantially infinite ratio arising when the shallow rib portions 168 have zero depth.

Transitions between the various depths of the rib portions are smooth, as illustrated in FIGS. 1-5. In some embodiments, however, the transitions may comprise other forms, such as by way of non-limiting example, a step-change connecting the varying depth portions. Moreover, some embodiments may minimize the shallow rib portions 156, 168 to 20-30% of the circumference of the container 100, thereby resulting in a respective 70-80%, of the container circumference comprising the deep rib portions 148, 160 and the middle rib portions 152, 164. However, any ratio of shallow rib portions to deep rib portions and middle rib portions may be utilized.

Figure 9:
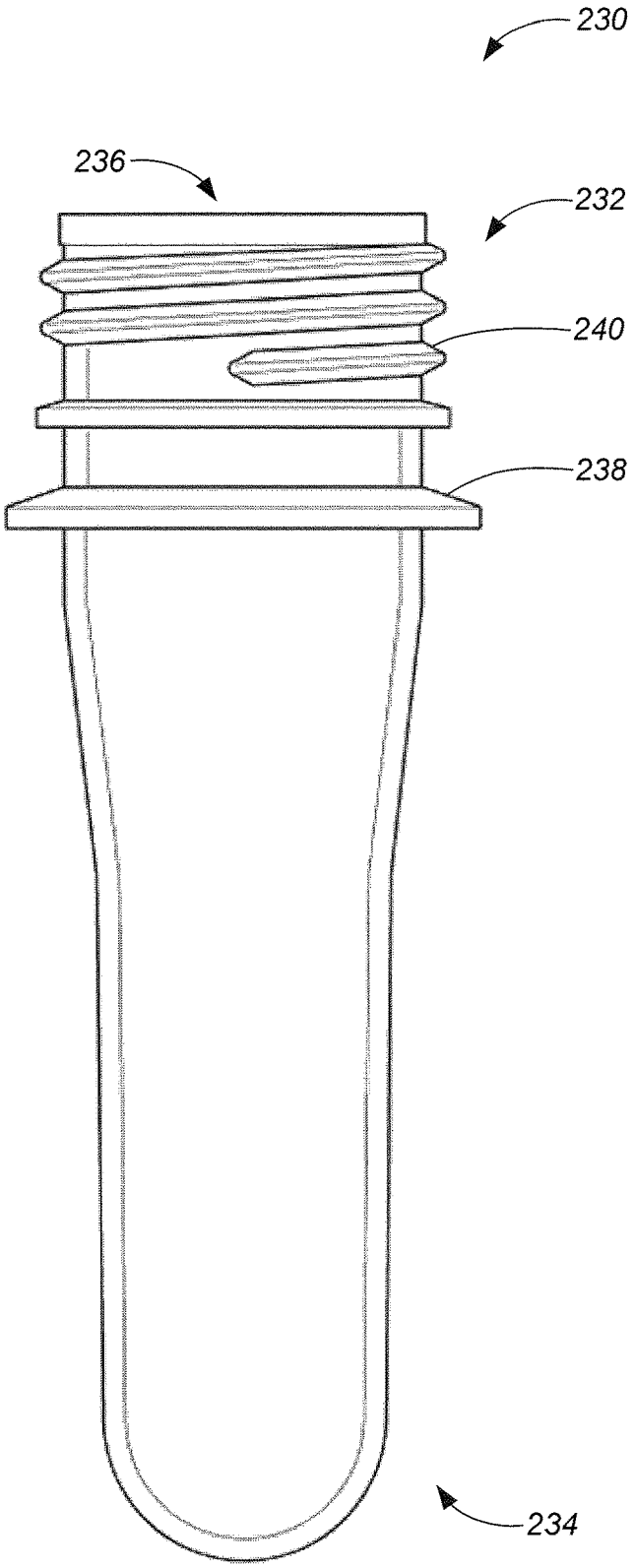
FIG. 9 illustrates an exemplary embodiment of a preform in which may be blow-molded to form a container in accordance with the present disclosure.

FIG. 9 illustrates an exemplary embodiment of a preform 230 which may be blow-molded to form the container 100. The preform 230 preferably is made of material approved for contact with food and beverages, such as virgin PET, and may be of any of a wide variety of shapes and sizes. The preform 230 comprises a neck portion 232 and a body portion 234, formed monolithically (i.e., as a single, or unitary, structure). Advantageously, the monolithic arrangement of the preform 230, when blow-molded into a bottle, such as container 100, provides greater dimensional stability and improved physical properties in comparison to a preform comprising separate neck and body portions, which are bonded together. The preform 230 illustrated in FIG. 9 generally is of a type which will form a 12-16 oz. beverage bottle, but as will be understood by those skilled in the art, other preform configurations may be used depending upon the desired configuration, characteristics and use of the final article. The preform 230 may be made by injection molding methods including those that are well known in the art.

Figure 10:
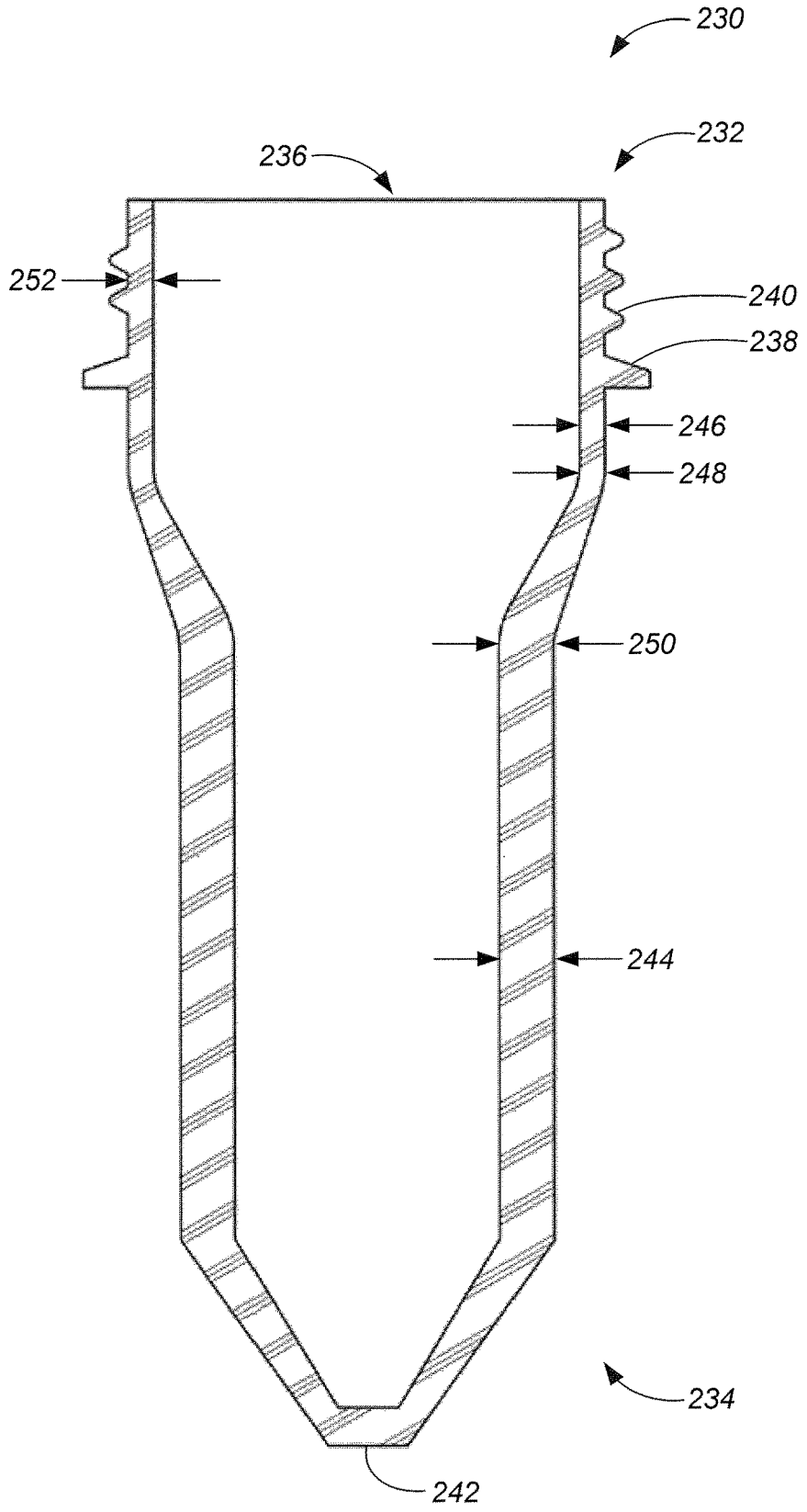
FIG. 10 illustrates a cross-sectional view of an exemplary embodiment of a preform, according to the present disclosure.

FIG. 10 illustrates a cross-sectional view of an exemplary embodiment of the preform 230 which may be used to form the container 100. The neck portion 232 of the preform 230 begins at an opening 236 to an interior of the preform 230 and extends to and includes a support ring 238. The neck portion 232 is further characterized by the presence of a structure for engaging a closure. In the illustrated embodiment, the structure includes threads 240, which provide a means to fasten a cap to the container 100 produced from the preform 230. It will be appreciated that the illustrated preform 230 comprises a shorter overall neck portion than most conventional preforms. Further, the neck portion 232 of the preform 230 comprises a wall thickness 252 which is generally thinner than in conventional preforms, wherein the wall thickness 252 of the neck portion 232 is measured at the very top or between the threads 240, or between any other protruding structures.

The body portion 234 is an elongated structure extending down from the neck portion 232 and culminating in an end cap 242. In some embodiments, the body portion 234 is generally cylindrical, and the end cap 242 is conical or frustoconical, and may also be hemispherical, and the very terminus of the end cap 242 may be flattened or rounded. The preform 230 comprises a wall thickness 244 throughout most of the body portion 234 which depends upon an overall size of the preform 230, as well as a predetermined wall thickness and overall size of the resulting container 100. As illustrated in FIG. 10, the wall thickness 244 tapers, between 250 and 248, to a wall thickness 246 immediately below the support ring 238. In some embodiments, the wall thickness between 244 and 250 may further comprise a slight taper so as to facilitates a release of the preform 230 from a core during the injection molding process. Specific dimensions of the wall thickness, as well as dimensions of various other features of the preform 230 are discussed in detail in U.S. patent application Ser. No. 13/295,699, entitled "Preform Extended Finish for Processing Light Weight Ecologically Beneficial Bottles," filed on Nov. 14, 2011, the entirety of which is incorporated herein by reference and forms a part of the present disclosure.

Figure 11:
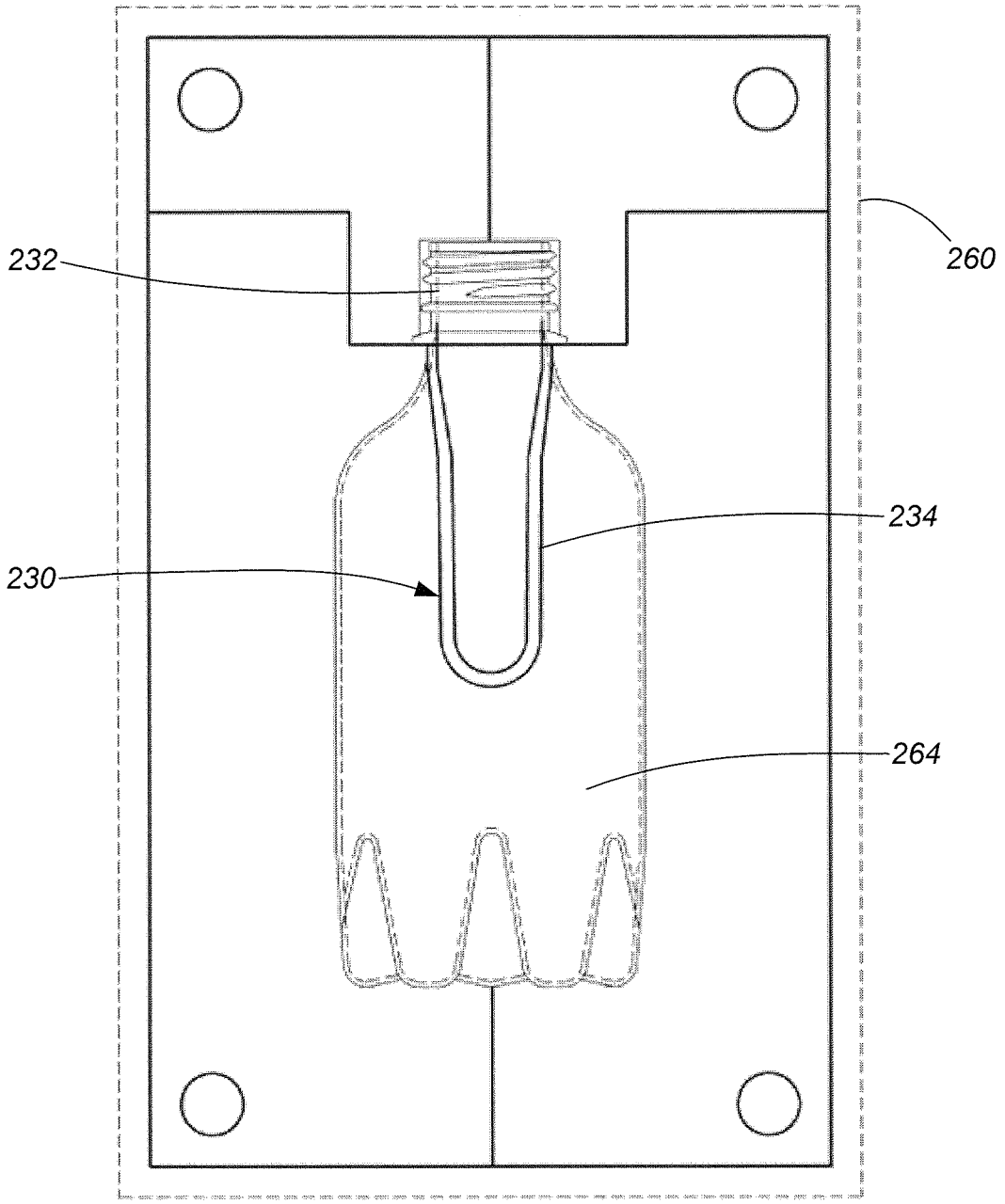
FIG. 11 illustrates a cross-sectional view of a preform in a cavity of an exemplary embodiment of a blow-molding apparatus that may be used to make a bottle or container.
Figure 12:
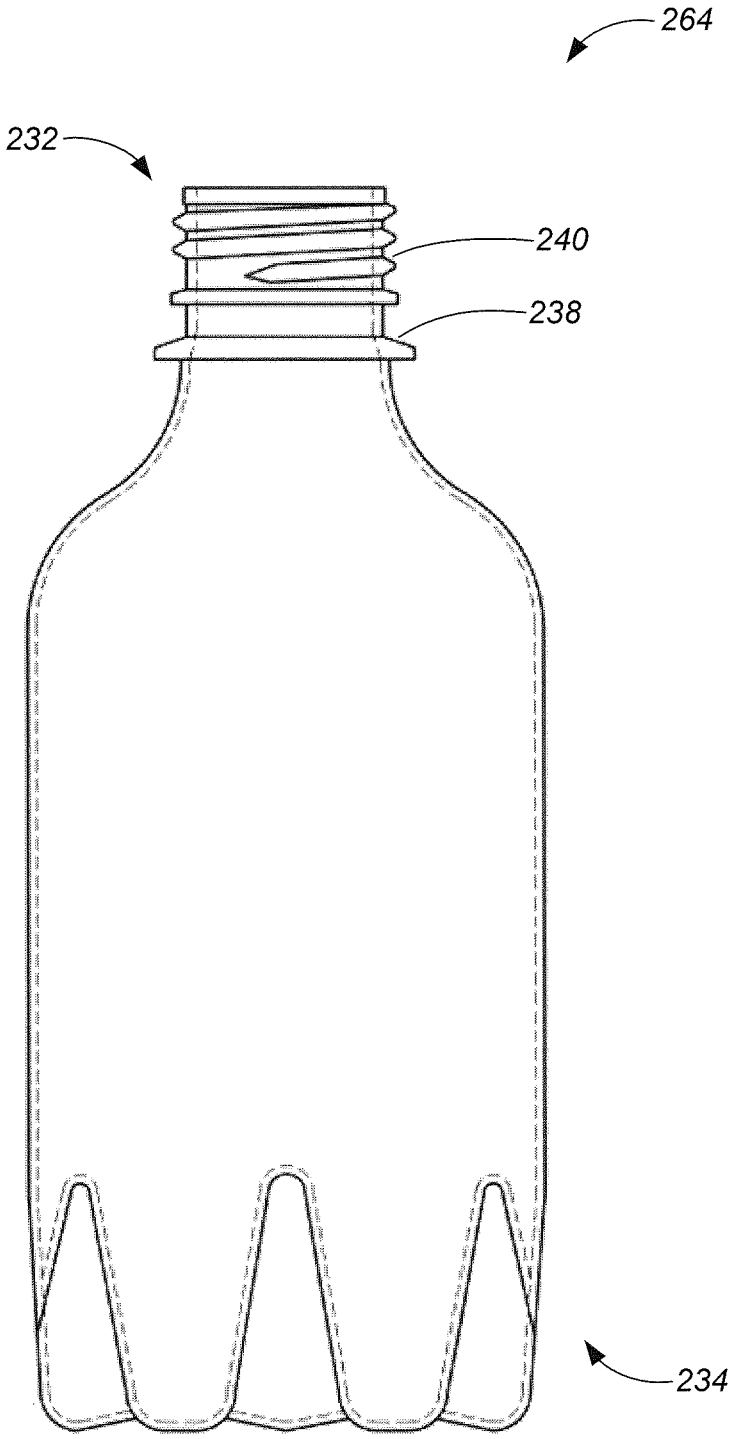
FIG. 12 illustrates an exemplary embodiment of a container formed by way of stretch blow-molding in accordance with the present disclosure.

Once the preform 230 has been prepared by way of injection molding, or other equivalent process, the preform 230 may be subjected to a stretch blow-molding process. As illustrated in FIG. 11, the preform 230 is placed in a mold 260 comprising a cavity corresponding to the desired container shape. The preform 230 is then heated and expanded by stretching such as by way of a stretch rod inserted into the center of the preform 230 to push it to the end of the mold 260 and by way of air forced into the interior of the preform 230 to fill the cavity within the mold 260, creating a container 264, as shown in FIG. 12. As illustrated in FIG. 12, the container 264 comprises a neck portion 232 and a body portion 234 corresponding to the neck and body portions of the preform 230 of FIG. 11. The neck portion 232 is further characterized by the presence of the threads 240 or other closure engagement means that provides a way to fasten a cap onto the container 264. Thus, the blow-molding process normally is restricted to the body portion 234 of the preform 230 with the neck portion 232, including the threads 240 and the support ring 238, retaining the original configuration of the preform 230.

In some embodiments, the containers 100, 264 described herein may be made from any suitable thermoplastic material, such as polyesters including polyethylene terephthalate (PET), polyolefins, including polypropylene and polyethylene, polycarbonate, polyamides, including nylons (e.g. Nylon 6, Nylon 66, MXD6), polystyrenes, epoxies, acrylics, copolymers, blends, grafted polymers, and/or modified polymers (monomers or portion thereof having another group as a side group, e.g. olefin-modified polyesters). These materials may be used alone or in conjunction with each other. More specific material examples include, but are not limited to, ethylene vinyl alcohol copolymer ("EVOH"), ethylene vinyl acetate ("EVA"), ethylene acrylic acid ("EAA"), linear low density polyethylene ("LLDPE"), polyethylene 2,6- and 1,5-naphthalate (PEN), polyethylene terephthalate glycol (PETG), poly(cyclohexylenedimethylene terephthalate), polystryrene, cycloolefin, copolymer, poly-4-methylpentene-1, poly(methyl methacrylate), acrylonitrile, polyvinyl chloride, polyvinylidine chloride, styrene acrylonitrile, acrylonitrile-butadiene-styrene, polyacetal, polybutylene terephthalate, ionomer, polysulfone, polytetra-fluoroethylene, polytetramethylene 1,2-dioxybenzoate and copolymers of ethylene terephthalate and ethylene isophthalate. In certain embodiments, preferred materials may be virgin, pre-consumer, post-consumer, regrind, recycled, and/or combinations thereof.

In some embodiments, polypropylene also refers to clarified polypropylene. As used herein, the term "clarified polypropylene" is a broad term and is used in accordance with its ordinary meaning and may include, without limitation, a polypropylene that includes nucleation inhibitors and/or clarifying additives. Clarified polypropylene is a generally transparent material as compared to the homopolymer or block copolymer of polypropylene. The inclusion of nucleation inhibitors helps prevent and/or reduce crystallinity, which contributes to the haziness of polypropylene, within the polypropylene. Clarified polypropylene may be purchased from various sources such as Dow Chemical Co. Alternatively, nucleation inhibitors may be added to polypropylene.

As used herein, "PET" includes, but is not limited to, modified PET as well as PET blended with other materials. One example of a modified PET is IP A-modified PET, which refers to PET in which the IPA content is preferably more than about 2% by weight, including about 2-10% IP A by weight, also including about 5-10% IP A by weight. In another modified PET, an additional comonomer, cylohexane dimethanol (CHDM) is added in significant amounts (e.g. approximately 40% by weight or more) to the PET mixture during manufacture of the resin. Additional techniques for forming the container 264, including additional materials, properties of the materials, as well as various advantageous additives are discussed in detail in U.S. patent application Ser. No. 13/295,699, entitled "Preform Extended Finish for Processing Light Weight Ecologically Beneficial Bottles," filed on Nov. 14, 2011, the entirety of which is incorporated herein by reference and forms a part of the present disclosure.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present invention is to be understood as not limited by the specific embodiments described herein, but only by scope of the appended claims.

What is claimed is:

1. A container configured to substantially reduce triangulation of the container due to internal pressure of contents within the container, the container comprising:

a base which extends upward to a sidewall of the container;

a shoulder connected between the sidewall and a bell, a diameter of the bell decreasing as the bell extends upward to a neck of the container;

a finish connected to the neck, the finish configured to receive a closure and defining an opening to an interior of the container; and a plurality of inwardly offset portions of the sidewall configured to resist outward bowing of the sidewall due to the internal pressure of the contents;

vertically aligned shallow rib portions that form a plurality of vertically aligned recessed columns comprising three recessed columns equally spaced around the perimeter of the sidewall, such that the sidewall comprises a circumference which is offset from a generally circular cross-sectional shape to a substantially triangular cross-sectional shape;

wherein portions of the sidewall are inwardly offset between each pair of adjacent, vertically aligned recessed columns;

a grip portion comprising a plurality of grip portion ribs that vary in depth, and angulate around the grip portion, wherein each grip portion rib comprises a deep rib portion transitioning to a middle rib portion and then transitioning to a shallow rib portion;

a label portion connected to the grip portion and comprising one or more label panel ribs, wherein each label portion rib comprises a deep rib portion transitioning to a middle rib portion and then transitioning to a shallow rib portion, and wherein the label portion transitions into the shoulder;

the plurality of inwardly offset portions are configured to counteract outward-directed forces on the sidewall of the container due to internal pressure, such that the pressurized container assumes a substantially circular cross-sectional shape; and wherein each of the inwardly offset portions is offset from 0 to 30 degrees from the circular cross-sectional shape; and wherein the deep rib portions of the grip portion ribs and label panel ribs provide a hoop strength equivalent to the hoop strength imparted by ribs comprising a uniform depth; the label portion comprising a different number of recessed columns than the grip portion; and a plurality of strap ribs, wherein each of the strap ribs extends substantially from a central portion of the base, wherein the strap ribs cooperate with a plurality of vertically aligned recessed columns of the sidewall so as to resist at least one of bending, leaning, crumbling, or stretching along the sidewall and the base; wherein at least one strap rib comprises a sidewall end that terminates past at least one of the shallow rib portions.

2. The container of claim 1, wherein the base comprises a diameter which is larger than a diameter of the shoulder, such that the base creates a single point of contact with other substantially similar containers in a production line, or in packaging.

3. The container of claim 1, wherein the diameter of the base is larger than the diameter of the shoulder by 0.5 to 4 millimeters.

4. The container of claim 1, wherein the diameter of the base is larger than the diameter of the shoulder by 1 to 2 millimeters.

5. A container comprising a base, a bell, a sidewall between the base and the bell, a neck and a finish which define an opening to an interior of the container, and a shoulder between the sidewall and the bell, the container comprising:

a grip portion of the sidewall comprising a multiplicity of circumferentially positioned grip portion ribs that vary in depth, and swirl around the grip portion, wherein each grip portion rib comprises a deep rib portion transitioning to a middle rib portion and then transitioning to a shallow rib portion;

a label portion connected to the grip portion and comprising one or more label panel ribs, wherein the label portion transitions into the shoulder;

the label portion comprising a multiplicity of circumferentially positioned label portion ribs, wherein each label portion rib comprises a deep rib portion transitioning to a middle rib portion and then transitioning to a shallow rib portion;

a plurality of strap ribs, wherein each of the strap ribs extends substantially from a central portion of the base and terminates at a sidewall end in the grip portion, and wherein the strap ribs cooperate with vertically aligned shallow rib portions that form a plurality of vertically aligned recessed columns so as to resist at least one of bending, leaning, crumbling, or stretching along the sidewall and the base, wherein portions of the sidewall are inwardly offset between each pair of adjacent, vertically aligned recessed columns;

a plurality of load ribs spaced equally between adjacent strap ribs, wherein the load ribs are configured to resist deformation of the base;

a plurality of feet formed between the strap ribs and the load ribs, wherein the plurality of feet comprises a resting surface of the container, and wherein two load ribs are positioned between two strap ribs; and the plurality of vertically aligned recessed columns comprises three recessed columns equally spaced around the perimeter of the sidewall, such that the sidewall comprises a circumference which is offset from a generally circular cross-sectional shape to a substantially triangular cross-sectional shape; and the plurality of inwardly offset portions are configured to counteract outward-directed forces on the sidewall of the container due to internal pressure, such that the pressurized container assumes a substantially circular cross-sectional shape.

6. The container of claim 5, wherein the diameter of the base is larger than the diameter of the shoulder by 0.5 to 4 millimeters.

7. The container of claim 5, wherein the diameter of the base is larger than the diameter of the shoulder by 1 to 2 millimeters.

8. The container of claim 5, wherein the base comprises a diameter which is larger than a diameter of the shoulder, such that the base creates a single point of contact with other substantially similar containers in a production line, or in packaging.

9. The container of claim 5, wherein the base further comprises a gate centered on a longitudinal axis of the container, a wall extending from the gate toward the resting surface of the container, and a dome immediately surrounding the gate, wherein the dome is a portion of the wall of the base that slopes more steeply toward the resting surface of the container.

10. The container of claim 5, wherein each of the strap ribs has a base end which terminates in the dome, near the periphery of the gate.

* * * * *